US006739683B2

(12) United States Patent
Shimomura et al.

(10) Patent No.: US 6,739,683 B2
(45) Date of Patent: May 25, 2004

(54) INK-JET RECORDING APPARATUS

(75) Inventors: Masaki Shimomura, Nagano-ken (JP); Hiroshi Asawa, Nagano-ken (JP); Masahiro Isono, Nagano-ken (JP); Yoichi Kobayashi, Nagano-ken (JP); Koji Hashiuchi, Nagano-ken (JP); Hiroyuki Tajima, Nagano-ken (JP); Kenjiro Ishihara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 32 days.

(21) Appl. No.: 09/968,075

(22) Filed: Oct. 1, 2001

(65) Prior Publication Data

US 2002/0057302 A1 May 16, 2002

(30) Foreign Application Priority Data

| | | |
|---|---|---|
| Oct. 2, 2000 | (JP) | 2000-306632 |
| Oct. 2, 2000 | (JP) | 2000-306638 |
| Oct. 20, 2000 | (JP) | 2000-327013 |
| Sep. 3, 2001 | (JP) | 2001-266045 |
| Sep. 3, 2001 | (JP) | 2001-266046 |
| Sep. 28, 2001 | (JP) | 2001-299469 |

(51) Int. Cl.[7] ..... B41J 25/308
(52) U.S. Cl. ..... 347/8; 400/55; 400/59
(58) Field of Search ..... 347/108, 101, 347/104, 8; 400/55–60, 625, 636, 636.3, 637.1

(56) References Cited

U.S. PATENT DOCUMENTS

| | | | | |
|---|---|---|---|---|
| 5,129,748 A | | 7/1992 | Brandon et al. | 400/605 |
| 5,408,257 A | * | 4/1995 | Hiramatsu et al. | 347/92 |
| 5,961,224 A | | 10/1999 | Baitz et al. | 400/56 |

FOREIGN PATENT DOCUMENTS

| | | |
|---|---|---|
| EP | 0 895 869 A2 | 10/1999 |
| JP | 63-144063 | 6/1988 |
| JP | 2-92667 | 4/1990 |
| JP | 2-233275 | 9/1990 |
| JP | 4-9153 | 2/1992 |
| JP | 04-347678 | 12/1992 |
| JP | 8-11353 | 1/1996 |
| JP | 08-207389 | 8/1996 |
| JP | 08-252960 | 10/1996 |
| JP | 09-099607 | 4/1997 |
| JP | 2000-198552 | 7/2000 |

* cited by examiner

*Primary Examiner*—Stephen D. Meier
*Assistant Examiner*—Ly T Tran
(74) *Attorney, Agent, or Firm*—John J. Penny, Jr.; Edwards & Angell, LLP

(57) ABSTRACT

An ink jet recording apparatus includes a paper gap switching portion for switching paper gaps by moving a recording head, a pressing-force adjustment portion for applying a pressure to a following roller and releasing the pressure from the following roller so as to adjust a pressing force applied to a recording medium, and an operation member for controlling a driving operation of the paper gap switching portion and a driving operation for the pressing-force adjustment portion.

22 Claims, 21 Drawing Sheets

INK-JET RECORDING APPARATUS

The present patent application claims priority from Japanese patent applications Nos. 2000-306632 filed on Oct. 2, 2000, 2000-306638 filed on Oct. 2, 2000, 2000-327013 filed on Oct. 20, 2000, 2001-266045 filed on Sep. 3, 2001, 2001-266046 filed on Sep. 3, 2001, 2001-299469 filed on Sep. 28, 2001, the contents of which are incorporated herein by reference.

BACKGROUND OF THE INVENTION

1. Field of the Invention

The present invention relates to an ink jet recording apparatus that ejects ink droplets from a recording head toward a recording medium that is being fed by paper-feeding rollers and following rollers while being held between the rollers.

Further, the present invention relates to an ink jet recording apparatus, in particular, to an inkjet printer capable of performing both unidirectional printing and bidirectional printing.

2. Description of the Related Art

An ink jet printer, that is one of an ink jet recording apparatus, generally supplies a recording medium such as paper via an auto-sheet feeder (automatic successive sheet-feeding mechanism) or manually via a paper feed-in openings, and then feed the recording medium into a gap between a paper-feeding roller and a following roller. While the paper is transported by rotating the paper-feeding roller, a pressure is applied to ink in a pressure-generating chamber of a recording (printing) head so as to eject ink droplets toward the paper, thereby information is printed onto the paper.

The above ink jet printer can normally perform printing on both plain paper and thick paper. In order to keep a printing quality high and substantially constant, a distance defined between a paper surface and a plane on which nozzle openings are arranged, i.e., a paper gap, is required to be always kept approximately constant by moving and adjusting the print head by means of a moving means for the print head.

The plain paper has a thickness of about 0.6 mm or less, containing the variation, for example. In this case, the print head is controlled to move to adjust the paper gap to realize about 1.2 mm. On the other hand, the thick paper has a thickness of about 0.7 mm to 1.5 mm containing the thickness variation. Thus, a position of the print head for the thick paper is moved upward from the position for the plain paper by about 0.9 mm.

Moreover, a serial non-impact type ink jet printer, for example, can select either unidirectional printing or bidirectional printing in a case of printing black-and-white text data such as characters, numerical characters and pieces of ruled lines. In the unidirectional printing, printing is performed in a predetermined one of two directions contained in a main scanning direction (i.e., a horizontal direction). This printing may be called as a high-quality printing mode. On the other hand, in the bidirectional printing, printing is performed both in a direction from left to right and a direction from right to left that correspond to the two directions contained in the main scanning direction. Such a printing may be called as a high-speed printing mode.

In the unidirectional printing, the printing is always performed in a predetermined direction. Thus, a path of the printing, that is, the moving amount of the print head, increases, thereby increasing a time required for the printing. In the unidirectional printing, however, effects of shift of printing positions caused by a mechanical accuracy of the print head or the like are extremely small. Therefore, high-quality printing can be achieved. On the other hand, in the bidirectional printing, the printing is performed from both ends in the horizontal direction. Thus, the printing path is reduced to a half of that of the unidirectional printing, thereby shortening the printing time. The bidirectional printing, however, is largely influenced by the printing position shifts. Therefore, in a case of printing what is composed of printing dots connected in a vertical direction (sub-scanning direction), such as a character of a double height size and a ruled line running in the vertical direction, discontinuity of the printing dots may be visualized, thereby degrading the printing quality. Thus, the user can select one of the unidirectional printing and the bidirectional printing for each printing job, i.e., each document, considering a type of the document to be printed.

In addition, the document to be printed may include a part of full-size characters and the like for which the bidirectional printing can be performed, and another part of the double-height-size characters, the vertical ruled lines and the like, which is to be printed by the unidirectional printing. Thus, in the case of selecting one of the unidirectional printing and the bidirectional printing for each printing job, the increase of the unnecessary printing path increases the printing time, or the printing quality is degraded in some parts of the document. Therefore, printing manners have been proposed in which expanded image data is analyzed in order to determine, depending on the contents of the image data, which one of the unidirectional printing and the bidirectional printing is to be performed (Post-examined Japanese Patent Publication No. 4-9153 and Unexamined Japanese Patent Applications (OPI) Nos. 2-233275 and 8-11353, for example)

Moreover, an information recordable disk in which information can be personally recorded, such as a CD-R, CD-RW, DVD-RAM or the like, has been becoming popular in recent years. Also, demands for personally printing a label on the printed disk have been increased. In this case, the label on the information recordable disk can be printed by supplying the information recordable disk with a tray made of extra-thick paper to the ink jet printer. Further, the performances of the ink jet printers have been enhanced in recent years, so that some ink jet printers can perform a high accuracy full-color printing not only on plain paper and special-purpose paper but also on various types of thick paper.

The conventional ink jet printer is designed, based on the assumption that the maximum thickness of paper handled by the ink jet printer is that of the thick paper, in such a manner that the thick paper manually fed in is allowed to press up against the following roller by its leading end and to be sandwiched between the paper-feeding roller and the following roller even if the following roller is pressed against the paper-feeding roller.

The extra-thick paper used for the tray for fixing the information recordable disk, however, has the thickness of about 1.6 mm to 2.5 mm. Thus, if the extra-thick paper is manually fed in and presses up against the following roller by its leading end, the pressing force F at the end of the extra-thick paper PPP works in a direction to rotate the following roller 1, as shown in FIG. 21, failing to push up the following roller 1. Therefore, it is difficult to clamp the extra-thick paper PPP between the paper-feeding roller 2 and the following roller 1.

The above problems can be solved by providing a release member for the following roller in the ink jet printer, which urges the following roller against the paper-feeding roller after the following roller has been released from the paper-feeding roller and then the extra-thick paper has been manually inserted into a space between the paper-feeding roller and the following roller. In a conventional ink jet printer having such a release member, however, an operation lever for the moving means for the print head and an operation lever for the release member for the following roller are provided separately from each other. Thus, the mechanism becomes complicated and cannot be determined uniquely, and therefore the design of the mechanism also becomes complicated and the design error tends to occur.

Moreover, the thick paper has the thickness of about 0.7 mm to 1.5 mm, as described above. This means the thickness of the thick paper has variation of about 0.8 mm. Moreover, in a case of extra-thick paper for printing CD-R or the like, the thickness is in the range of about 1.6 mm to 2.5 mm. Thus, the variation range of the thickness reaches about 0.9 mm. As described above, the thickness of the thick paper or the extra-thick paper changes depending on the type of paper, thus causing large differences of the paper gap between the types of paper.

Therefore, when relatively thin thick-paper is used, the paper gap becomes large and the shifts of dot-printing positions between the two directions in the bidirectional printing also become large. This may cause the printing quality to be degraded. There are some printers that can correct the positional shifts with a constant rate in the bidirectional printing. Such correction, however, is performed based on the assumption that the paper gap is constant. Thus, when the paper thickness changes depending on the type of the thick paper, stable printing quality cannot be achieved. Moreover, if a correction value in the above correction is changed to be several values depending on the type of the thick paper, causing control of the printing to be extremely complicated.

SUMMARY OF THE INVENTION

Therefore, it is an object of the present invention to provide an ink jet recording apparatus, which is capable of overcoming the above drawbacks accompanying the conventional art. More specifically, it is an object of the present invention to provide an ink jet recording apparatus that can uniquely adjust a recording head and a following roller simply. Further, it is another object of the present invention to provide an ink jet recording apparatus that can perform high accuracy printing with stable printing quality on any type or thickness of thick paper. The above and other objects can be achieved by combinations described in the independent claims. The dependent claims define further advantageous and exemplary combinations of the present invention.

According to the first aspect of the present invention, an ink jet recording apparatus having a feed roller and a following roller operable to interpose recording medium and to feed the recording medium, and a recording head operable to eject ink droplets onto the recording medium, the apparatus comprises: a paper gap switching portion operable to switch paper gaps by moving the recording head; a pressing-force adjustment portion operable to apply a pressure to the following roller or release the pressure to adjust a pressing force applied to the recording medium; and an operation member operable to operate in series two series of driving operations including a driving operation of the paper gap switching portion and a driving operation of the pressing-force adjustment portion.

Thus, since the paper gap switching portion and the pressing-force adjustment portion can be operated by the operation of the operation member only, it is possible to smoothly perform the switching of the paper gaps and the adjustment of the pressing force without fail, improving the user's operability. Moreover, since the functions of switching the paper gaps and adjusting the pressing force are integrated with the function of operating those functions, the structures of the operation member, the paper gap switching portion and the pressing-force adjustment portion can be made simple, so that the design can be simplified and, therefore, the design error can be reduced. In addition, the cost for the manufacture and assembly and the number of the processes of the manufacture and assembly can be reduced.

The operation member may include an intermittent gear operable to switch and transmit the two series of driving operations. Thus, the switching of the two series of driving operations can be mechanically realized by simple components and therefore the switching operations can be performed with high accuracy without fail.

The operation member, the pressing-force adjustment portion and the paper gap switching portion may be formed by a gear mechanism and a link mechanism. Thus, since the operation member, the paper gap switching portion and the pressing-force adjustment portion can be formed by components having a relatively simple structure, the manufacturing cost can be reduced.

The operation member may include a first intermittent gear having an operation lever, a second intermittent gear arranged to be engageable with the first intermittent gear, and a third intermittent gear arranged to have the same rotation axis as the second intermittent gear; the pressing-force adjustment portion may include a fourth intermittent gear arranged to be engageable with the second intermittent gear and to have a shaft in which a part of a circumference is formed to be a flat surface, a fifth intermittent gear arranged to be engageable with the third intermittent gear, a following roller arm having one end onto which the following roller is rotatably mounted and another end rotatably attached to the shaft of the fourth intermittent gear, and a coil spring having an end fixed to the following roller, another end that is in contact with the shaft of the fourth intermittent gear and a center part fitted to approximately at a center of the following roller arm; and the paper gap switching portion may include a first link fitted to a shaft of the fifth intermittent gear at its one end, a second link hinged at its one end to another end of the first link, a third link hinged at its one end to another end of the second link, a fourth link hinged at its one end to the one end of the third link, a fifth link hinged at its one end to another end of the fourth link, and an eccentric cam, to which the recording head is attached, connected to another end of the third link, the fifth link being supported at its another end by a body of the ink jet recording apparatus.

Thus, since the operation member, the paper gap switching portion and the pressing-force adjustment portion can be formed by components having a relatively simple structure, the manufacturing cost can be reduced. Moreover, since the switching of the two series of driving operations can be mechanically realized by simple components, the switching operations can be performed with high accuracy without fail.

The ink jet recording apparatus may further include a click mechanism, formed integrally with the operation lever, operable to position the operation lever when the pressing force adjustment portion applies the pressure and when the pressing force adjustment portion release the pressure. Thus, as compared with a case where the click mechanism is formed separately from the operation lever, the touch of clock when the operation lever has been positioned is transmitted more directly, so that excellent touch of click can be obtained.

A position of the operation lever when the pressing-force adjustment portion applies the pressure may be arranged to be a part from a further position of the operation lever when the pressing-force adjustment portion releases the pressure. Thus, the user can clearly confirm whether the pressing-force adjustment portion is placed in a state of the pressure application or a state of the pressure release, only by viewing the operation lever. Therefore, error operations can be prevented.

The second link and the forth link may be arranged on the same side of the body of the recording apparatus. Thus, since the operation of the second link can be transmitted directly to the fourth link, it is possible to prevent the transmission failure caused by an unstable connection between the second and fourth links in a case where the second and fourth links are arranged on both side of the body, respectively.

The maximum one of the paper gaps is provided when the pressing-force adjustment portion release the pressure. Thus, since a distance between the print head and a recording state while the pressure is released and a distance between the feeding roller and the following roller are enough, it is possible to smoothly transport an even thick recording member between the respective components.

According to the second aspect of the present invention an ink jet recording apparatus having a feeding roller and a following roller operable to feed a recording medium while interposing the recording medium, and a recording head operable to eject ink droplets on the recording medium, the apparatus includes: a paper gap switching portion operable to switch a first paper gap and a second paper gap by moving the print head, the second paper gap being larger than the first paper gap; and a pressing-force adjustment portion operable to apply a pressure to the following roller or release the pressure to adjust a pressing force applied to the recording medium, wherein three states are switched by a single operation lever, the three states including a state where the first paper gap is set and the pressure is applied, another state where the second paper gap is set and the pressure is applied, and still another state where the pressure is released.

Thus, since the paper gap switching portion and the pressing-force adjustment portion can be operated by the operation of the operation member only, it is possible to smoothly perform the switching of the paper gaps and the adjustment of the pressing force without fail, improving the user's operability. Moreover, since the functions of switching the paper gaps and adjusting the pressing force are integrated with the function of operating those functions, the structures of the operation member, the paper gap switching portion and the pressing-force adjustment portion can be made simple, so that the design can be simplified. Therefore, the design error can be reduced, and the cost for the manufacture and assembly and the number of the processes of the manufacture and assembly can be reduced.

Switching positions of the operation lever for switching the three states may be arranged in series. Thus, the operations of the operation lever can be performed in series, so that the printing setting can be performed more quickly.

Operations at the switching positions may be arranged in an order of setting the first paper gap and applying the pressure, setting the second paper gap and applying the pressure, and releasing the pressure. Thus, since the operations are arranged in an order of the printing for plain paper having a normal thickness, the printing for thick paper thicker than the plain paper, insertion/discharge of the paper, and various types of printing can be performed more quickly.

The paper gap switching portion and the pressing-force adjustment portion may be formed by a gear mechanism and a link mechanism. Thus, since the operation member, the paper gap switching portion and the pressing-force adjustment portion can be formed by components having a relatively simple structure, the manufacturing cost can be reduced.

The pressure applied by the pressing-force adjustment portion may be applied by an elastic member. Thus, the application and the release of the pressing force can be performed simply without fail.

According to the third aspect of the present invention, an ink jet recording apparatus, having a print head for ejecting ink droplets on a recording medium, for performing printing for the recording medium by making the print head elect the ink droplets on the recording medium while the print head moves in a main scanning direction and the recording medium is moved in a sub-scanning direction, the apparatus includes: a unidirectional printing portion operable to perform unidirectional printing in which the printing is performed in one of two directions contained in the main scanning direction; a bidirectional printing portion operable to perform bidirectional printing in which the printing is performed in both the two directions contained in the main scanning direction; and a printing-mode controlling portion operable to prohibit the bidirectional printing by the bidirectional printing portion when a thickness of the recording medium is out of a predetermined range, to force the unidirectional printing portion to perform the unidirectional printing. Thus, in a case of a recording medium having a thickness out of the predetermined range, such as thick paper or extra-thick paper, the unidirectional printing is forced to perform. Therefore, the printing quality can be prevented from degrading.

According to the fourth aspect of the present invention, an ink jet recording apparatus, having a print head operable to eject ink droplets on a recording medium, for performing printing by making the print head eject the ink droplets on the recording medium while the print head moves in a main scanning direction and the recording medium is moved in a sub-scanning direction, the apparatus includes: a main controlling unit including a unidirectional printing portion operable to perform unidirectional printing in which the printing is performed in one of two directions contained in the main scanning direction and a bidirectional printing portion operable to perform bidirectional printing in which the printing is performed in both the two directions of the main scanning direction; and a paper gap switching portion operable to switch a first paper gap and a second paper gap by moving the print head in accordance with a thickness of the recording medium, the second paper gap being larger than the first paper gap, wherein the main controlling unit further includes a printing-mode controlling portion operable to prohibit the bidirectional printing by the bidirectional printing portion and to force the unidirectional printing portion perform the unidirectional printing, when the second paper gap is set by the paper gap switching portion.

Thus, the bidirectional printing can be automatically prohibited only by setting the second paper gap by means of the paper gap switching portion. Therefore, the degradation of the printing quality can be prevented.

At least switching between the first paper gap and the second paper gap may be preformed by a single operation lever, and the printing-mode controlling portion may prohibit the bidirectional printing and forces the unidirectional printing portion to perform the unidirectional printing, when the second paper gap is set by the operation lever.

Thus, the bidirectional printing can be automatically prohibited only by setting the second paper gap by means of the single operation lever. Therefore, the degradation of the printing quality can be prevented.

Moreover, without the user's selection, the unidirectional printing is automatically performed. Therefore, it is convenient to the user.

The main controlling unit may be arranged to allow selection of one of the unidirectional printing and the bidirectional printing, and even in a case where the bidirectional printing is selected, the printing-mode controlling portion may expand printing data generated for the bidirectional printing to obtain printing data for the unidirectional printing and only allows the unidirectional printing by the unidirectional printing portion to perform the unidirectional printing, when the thickness of the recording medium is out of a predetermined range and/or the second paper gap is set.

Thus, in a case of printing the thick paper or extra-thick paper while the user selected the bidirectional printing on the printer driver, for example, even when the main controlling unit received the printing data for the bidirectional printing from a host computer, the main controlling unit expands the received data again to be the data for the unidirectional printing and then performs the unidirectional printing. Therefore, without switching of the printing mode to the unidirectional printing by the user, the unidirectional printing is automatically performed, preventing the printing quality from being degraded without fail.

The paper gap-switching portion may be formed by a gear mechanism and a link mechanism.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
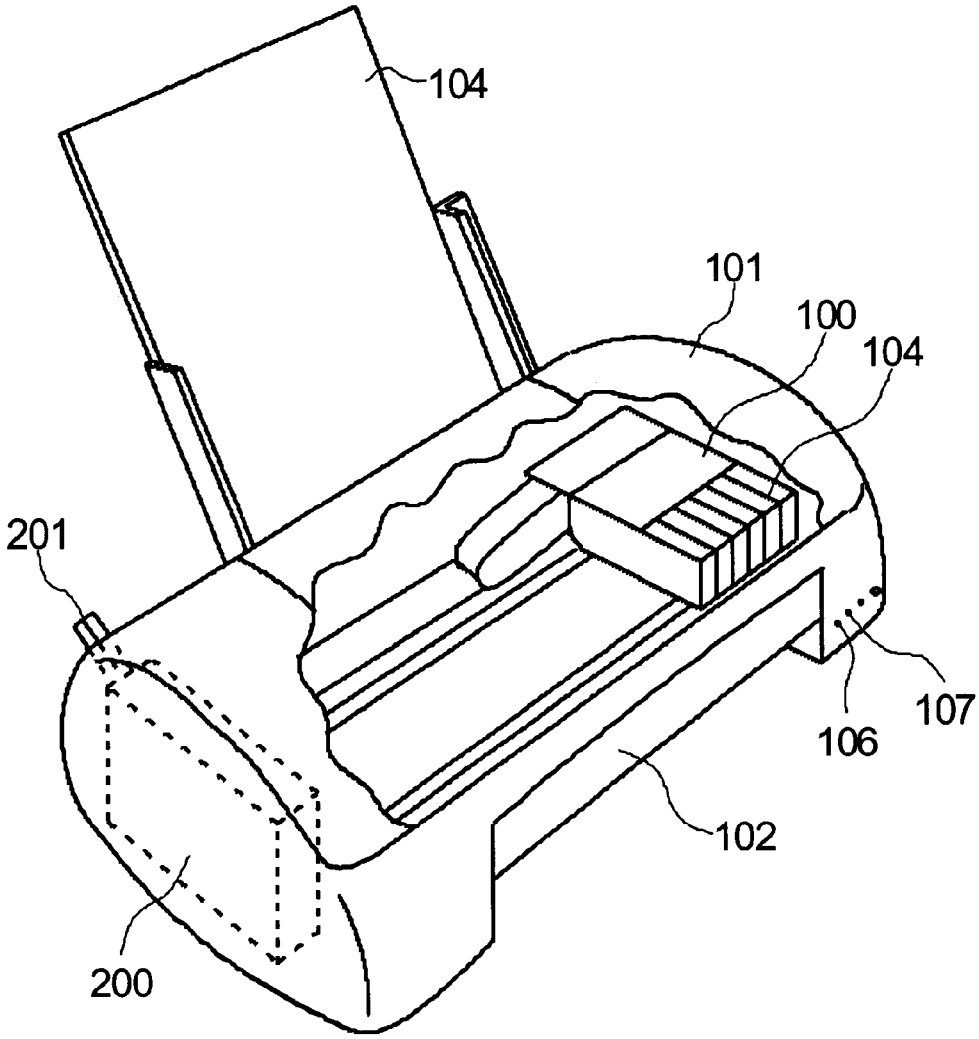
FIG. 1 is a perspective view of an ink jet printer as an exemplary ink jet recording apparatus according to an embodiment of the present invention, seen from the front side thereof.
Figure 2:
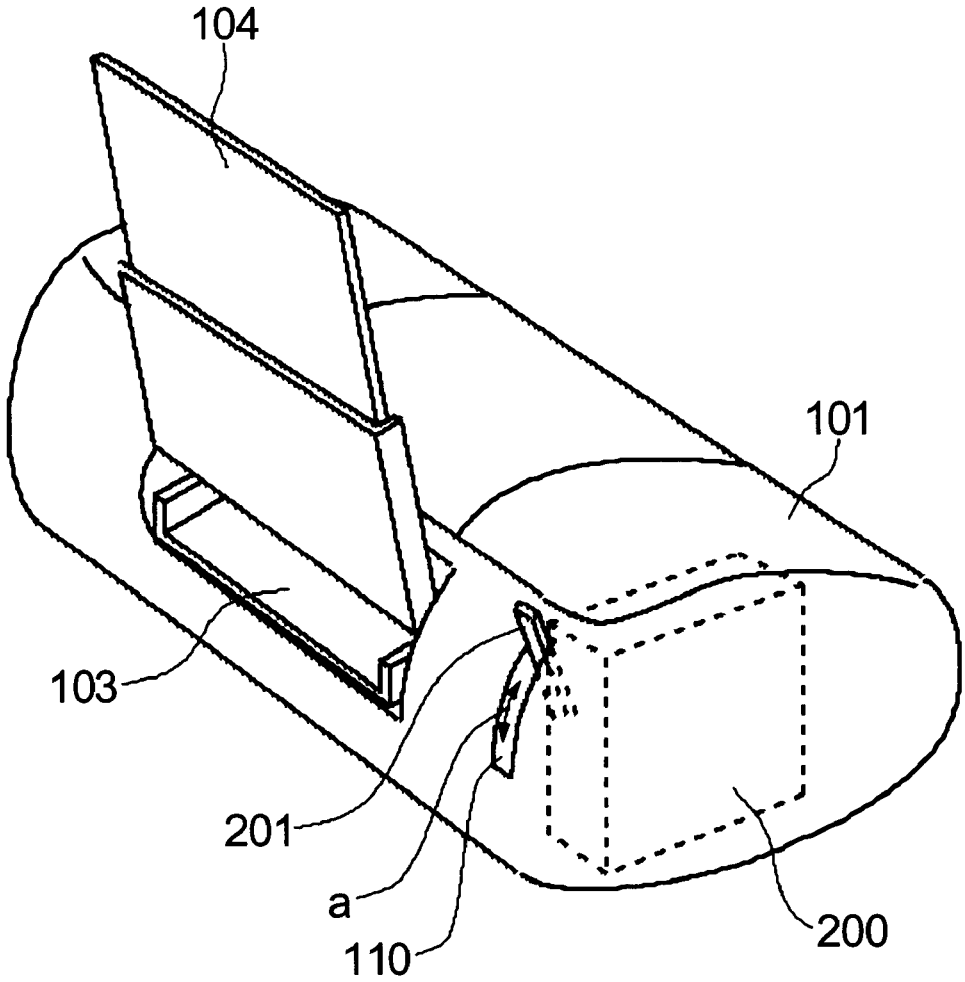
FIG. 2 is a perspective view of the ink jet printer shown in FIG. 1, seen from the rear side thereof.

FIGS. 1 and 2 are perspective views of an ink jet printer as an exemplary ink jet recording apparatus according to an embodiment of the present invention, seen from a front side and a rearside, respectively. The inkjet printer includes a recording (print) head 100, a head driving section (not shown), an auto sheet feeder (automatic successive feeding section, not shown), a paper gap switching portion/pressing-force adjustment portion 200 that are provided in a body 101. On the front side of the body 101 is provided a paper discharging opening 102. On the rear side of the body 101 is provided a paper feeding-in opening 103.

In addition, a tray 104 for the auto sheet feeder is provided above the paper feeding-in opening 103 on the rear side of the body 101. On one side of the paper feeding-in opening 103, an operation lever 201 that serves as an operation portion 200C (FIG. 3) of the paper gap switching portion/pressing-force adjustment portion 200 is provided to project from the body 101.

The print head 100 includes, for example, four color ink cartridges 105 including yellow, magenta, cyan and black ink cartridges and is arranged to allow full-color printing to be performed. Timings of ejecting ink droplets from the print head 100 and scan of the print head 100 by the head driving section are controlled by an exclusive controller board or the like, that is incorporated in the body 101, thereby realizing ink-dot control with high accuracy, half-tone process and the like.

Recording paper placed on the tray 104 is automatically fed by the auto sheet feeder to a space between a paper-feeding roller and a following roller (both not shown) and is further transported by the rollers while being sandwiched between the rollers. Finally, the paper is discharged via the paper discharging opening 102. Recording paper manually fed into the paper feeding-in opening 103 is similarly transported by the paper-feeding roller and the following roller while being sandwiched between the rollers, and is then discharged via the paper discharging opening 102.

As the recording paper fed from the tray 104, plain paper, special paper, recommended OHP sheet, coated paper, coated film, label sheet, official postcards and the like can be used. On the other hand, as the recording paper manually fed via the paper feeding-in opening 103, the above-mentioned types of paper, film and card, and thick material including thick paper and extra-thick paper (including a tray for an information recordable disk), that is, the material difficult to be folded can be used.

The operation lever 201 serving as the operation member 200C is arranged to be slidable along a slit 110 provided on the body 101 like a straight line along direction a, shown with double headed arrow in FIG. 2, in a step-like manner so as to set the paper gap switching portion/pressing-force adjustment portion 200. The paper gap switching portion is arranged to move and adjust the print head 100 so as to make the distance between the paper surface and a plane of nozzle openings of the print head 100, that is, the paper gap, approximately constant, in order to keep the printing precision high and approximately constant regardless of the thickness of the recording paper.

The pressing-force adjustment portion is arranged to press the following roller against the paper-feeding roller by applying pressure to the following roller in order to sandwich the recording paper between the rollers, or to release the following roller from the paper-feeding roller by releasing the above pressure in order to pull the recording paper out from the space between the rollers.

Figure 3:
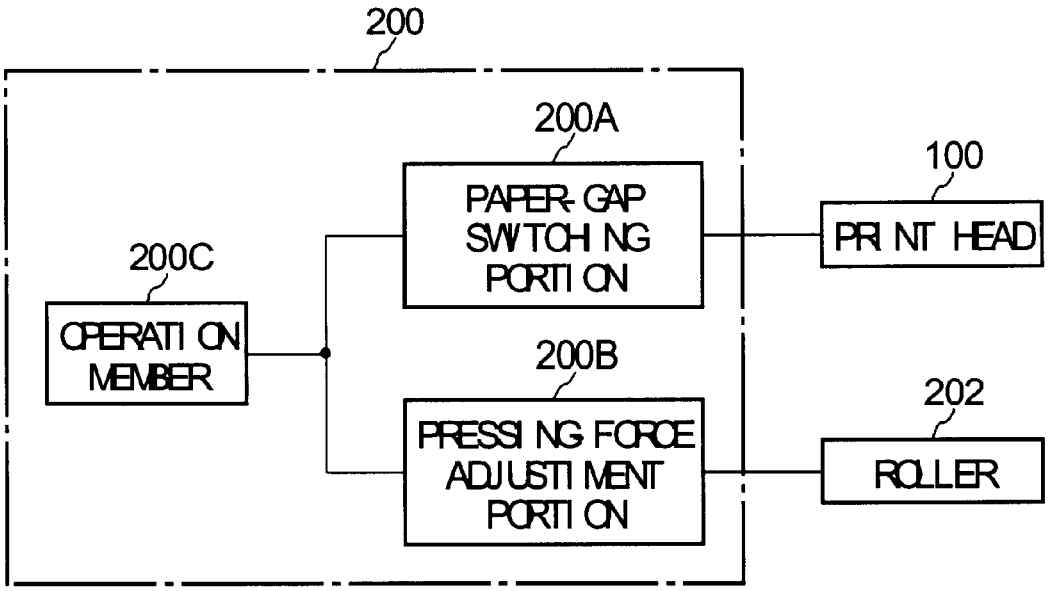
FIG. 3 is a block diagram illustrating relationships among an operation member, a paper gap switching portion and a pressing-force adjustment portion in the ink jet printer shown in FIG. 1.

FIG. 3 is a block diagram illustrating a relationship among the operation member 200C, a paper gap switching portion 200A and a pressing-force adjustment portion 200B in the paper gap switching/pressing-force adjustment portion 200. As shown in FIG. 3, the operation member 200C is provided in mechanical association with each of the paper gap switching portion 200A and the pressing-force adjustment portion 200B. By the sliding operation of only one operation lever 201 serving as the operation member 200C in the step-like manner, the paper gap switching portion 200A and the pressing-force adjustment portion 200B can be operated, so as to place the print head 100 and the following roller 202 in a desired state.

Figure 4:
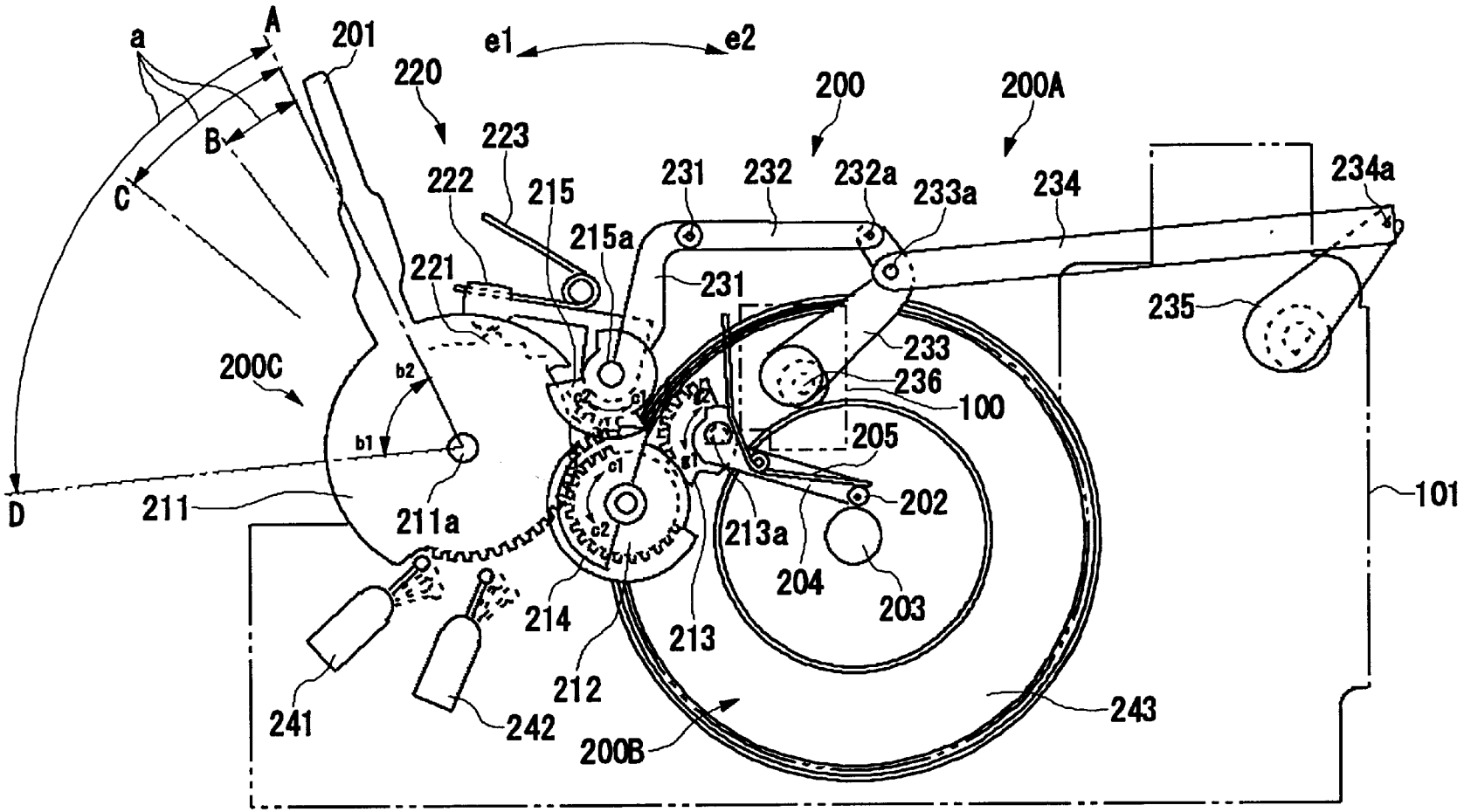
FIG. 4 is a side view showing a detailed example of a first state of the paper gap switching portion and the pressing-force adjustment portion in the ink jet printer shown in FIG. 1.

FIG. 4 is a cross-sectional view of the printer, seen from the side thereof, and illustrates a detailed example of the paper gap switching portion 200A and the pressing-force adjustment portion 200B. The operation member 200C includes a first intermittent gear 211 to which the operation lever 201 is integrally formed, and second and third intermittent gears 212 and 214. The paper gap switching portion 200A includes first, second, third, fourth and fifth links 231, 232, 233, 234, and 235 and an eccentric cam 236 to which the print head is attached. The pressing-force adjustment portion 200B includes a fourth intermittent gear 213 having a shaft 213*a* in which a part of a circumference is formed to be flat, a fifth intermittent gear 215, a following roller arm 204 with the following roller 202 rotatably mounted at its one end, and a coil spring 205.

The operation lever 201 is integrally formed with the first intermittent gear 211 so as to project from the circumferential part of the first intermittent gear 211, and can pivotally reciprocate in direction a, shown with double-headed arrow in FIG. 4. On the first intermittent gear 211, a wave-Like ratchet tooth 221 serving as a click mechanism 220 is formed integrally with the gear 211. Depressions of the wave-like ratchet tooth 221 are formed to correspond to positions A, B, C and D at which the operation lever 201 pivotally moved to be positioned. Moreover, a ratchet 222 of the click mechanism 220 is pressed against the ratchet tooth 221 by a coil spring 223.

Thus, when the user rotates the operation lever 201 to position the lever 201 at each of positions A, B, C and D, the ratchet 222 fits into the corresponding depression of the wave-like ratchet tooth 221. Therefore, the user can recognize by excellent touch of click that the operation lever 201 is positioned at the desired position without fail. If the operation lever 201 and the ratchet tooth 221 are formed as separate components, the touch of the click is not good because the touch is transmitted via the shaft 211*a* of the first intermittent gear 211. In this example, however, the touch of the click can be transmitted directly since the operation lever 201 is integrally formed with the ratchet gear 221, thus enabling the user to recognize that the operation lever 201 is positioned at the respective position without fail.

Here, positions A, B, C and D are briefly explained. When the operation lever 201 is positioned at position A, the recording paper having a normal thickness, that is, plain paper is used when the operation lever 201 is positioned at position B, slightly thicker recording paper than the plain paper, that is, thick paper is used. When the operation lever 201 is positioned at position C, very thick recording paper which is extra-thick paper containing a tray for information recordable disk is used. When the operation lever 201 is positioned at position D, the following roller 202 is released from the paper-feeding roller 203.

Positions A, B and C for the adjustment of the paper gap are arranged in such a manner that they are relatively close to each other. Position D at which the following roller 202 is released from the paper-feeding roller 203 by the operation lever 201, however, is arranged to be away from respective positions A, B and C by predetermined distances. Thus, when the user operates the operation lever 201, the user can recognize visually or by the physical sensation whether the paper gap is adjusted or the following roller 202 is released from the paper-feeding roller 203, thus preventing an wrong operation.

The first intermittent gear 211 is arranged to be engagable with the second intermittent gear 212, which is arranged to be engagable with the fourth intermittent gear 213. Also, the third intermittent gear 214, which is arranged to have the same axis as the second intermittent gear 212, is arranged to be engagable with the fifth intermittent gear 215.

The shaft 213*a* of the fourth intermittent gear 213 is a so-called D-shaft in which the circumferential surface thereof is formed to be flat. To the D-shaft 213*a*, an end of the following roller arm 204 is rotatably connected with the following roller 202 rotatably mounted on another end thereof. Approximately at a center part of the following roller arm 204, the center part of the coil spring 205 having an end fixed to the following roller 202 and another end that is in contact with the D-shaft 213*a* is fixed.

To a shaft 215*a* of the fifth intermittent gear 215, a free end of the first link 231, hinged to the second link 232 to form a substantially L-shape by a hinge 231*a*, is fitted. A free end of the second link 232 is hinged to an end of the third link 233 by a hinge 232*a* that is closer to the hinge 233*a* than another end of the third link 233. The third, fourth and fifth links 233, 234 and 235 are jointed by the hinges 233*a* and 234*a* to form an approximately U-shape. A free end of the third link 233 is connected to the print head 100 via the eccentric cam 236. A free end of the fifth link 235 is rotatably supported by the body 101 with a shaft.

In a case where the second link 232 is arranged on the left side of the body 101 when the printer is seen from the front side, the fourth link 234 is arranged on the right side of the body 101, and the second link 232 and the fourth link 234 are connected by a new link mechanism, for example, an extra space is generated on the left side of the body 101, thereby increasing the freedom of the design. However, loss of transmission of the operation of second link 232 to the fourth link 234 may result or the transmission may fail, since the transmission takes place via the new link mechanism.

On the other hand, in this example, the second and fourth links 232 and 234 are arranged on the same side of the body 101, i.e., the left side of the body 101 when the printer is seen from the front side. Thus, the operation of the second link 232 can be transmitted directly to the fourth link 234 without fail, so that the transmission loss or the fail of transmission can be prevented.

Moreover, below the first intermittent gear 211, limit switches 241 and 242 are provided. The limit switch 241 is provided for turning on/off the auto sheet feeder by rotation of the first intermittent gear 211. The other limit switch 242 is provided for turning on/off the printer. Furthermore, an encoder 243 is mounted to the paper-feeding roller 203, which encoder is used for controlling the paper-feeding roller 203 in the printing on the recording paper. More specifically, the encoder 243 is mounted on a rotor shaft of the paper-feeding roller 203 and rotates together with a paper-feeding motor for driving the paper-feeding roller 203. In the present embodiment, a DC motor is employed as the paper-feeding motor for the purpose of reducing noise from the motor. The encoder 243 generates electric pulse signals while rotating with the paper-feeding motor 203, and the pulse signals are counted to measure the rotation amount of the encoder 243, so that paper feeding amount by the paper-feeding roller 203 can be measured.

As described above, since the operation member 200C is provided for operating in series two series of driving operations including the driving of the paper gap switching portion 200A and the driving the pressing-force adjustment portion 200B, the switching of the paper gaps and the adjustment of the pressing force can be performed by the operation of the operation member 200C only. Therefore, it is possible to smoothly perform the switching of the paper gaps and the pressing-force adjustment without fail, improving the user's operability.

Moreover, since functions of switching the paper gaps and adjusting the pressing force are integrated with a function of operating those functions, the structures of the operation member 200C, the paper gap switching portion 200A and the pressing-force adjusting portion 200B can be simplified. Thus, the designs thereof are also simplified, thereby reducing the design error, the cost of fabrication and assembly, and the number of processes of the fabrication and assembly.

Figure 5:
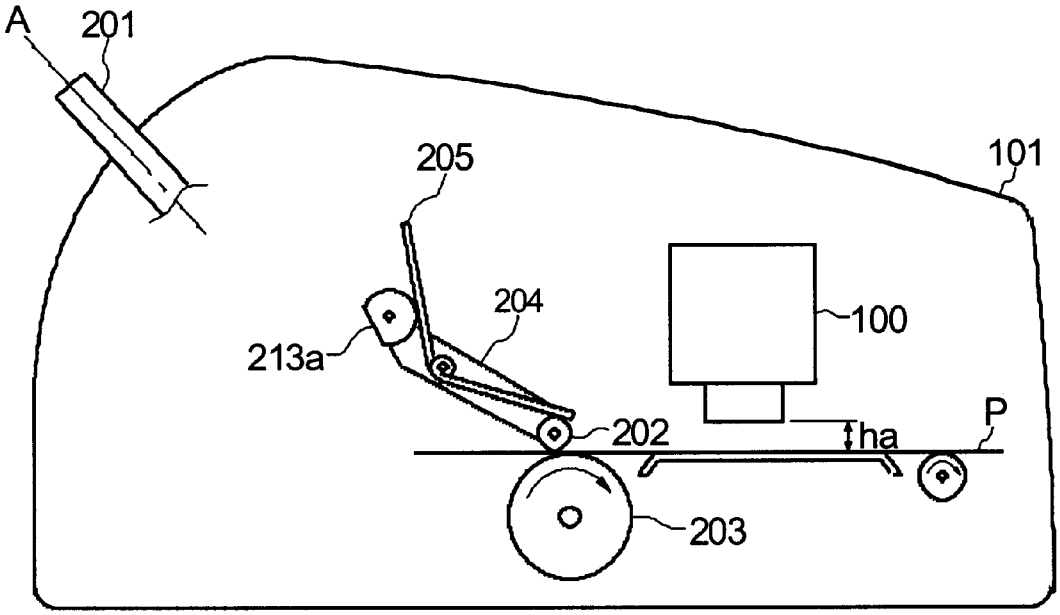
FIG. 5 is a side view showing a first example of an operation of the paper gap switching portion and the pressing-force adjustment portion in the ink jet printer shown in FIG. 1.

In the above structure, the operations of the above-mentioned components are described referring to FIGS. 4 to 14. In a state shown in FIG. 4, in which the operation lever 201 is positioned at position A, elastic force of the coil spring 205 pressed by the D-shaft 213*a* is applied to the following roller 202 so as to press plain paper P fed into a space defined between the paper-feeding roller 203 and the following roller 202, as shown in FIG. 5. The print head 100 is moved to provide the paper gap ha, that corresponds to the plain paper P, as shown in FIG. 5.

In this state, the print head 100 is moved and adjusted to realize the paper gap ha of about 1.2 mm, for example, because the typical thickness of the plain paper containing the variation is about 0.6 mm or less. Both the limit switches 241 and 242 in this state are turned on, and lamps 106 and 107 provided on the front side of the body 101, shown in FIG. 1, are lighted.

Figure 6:
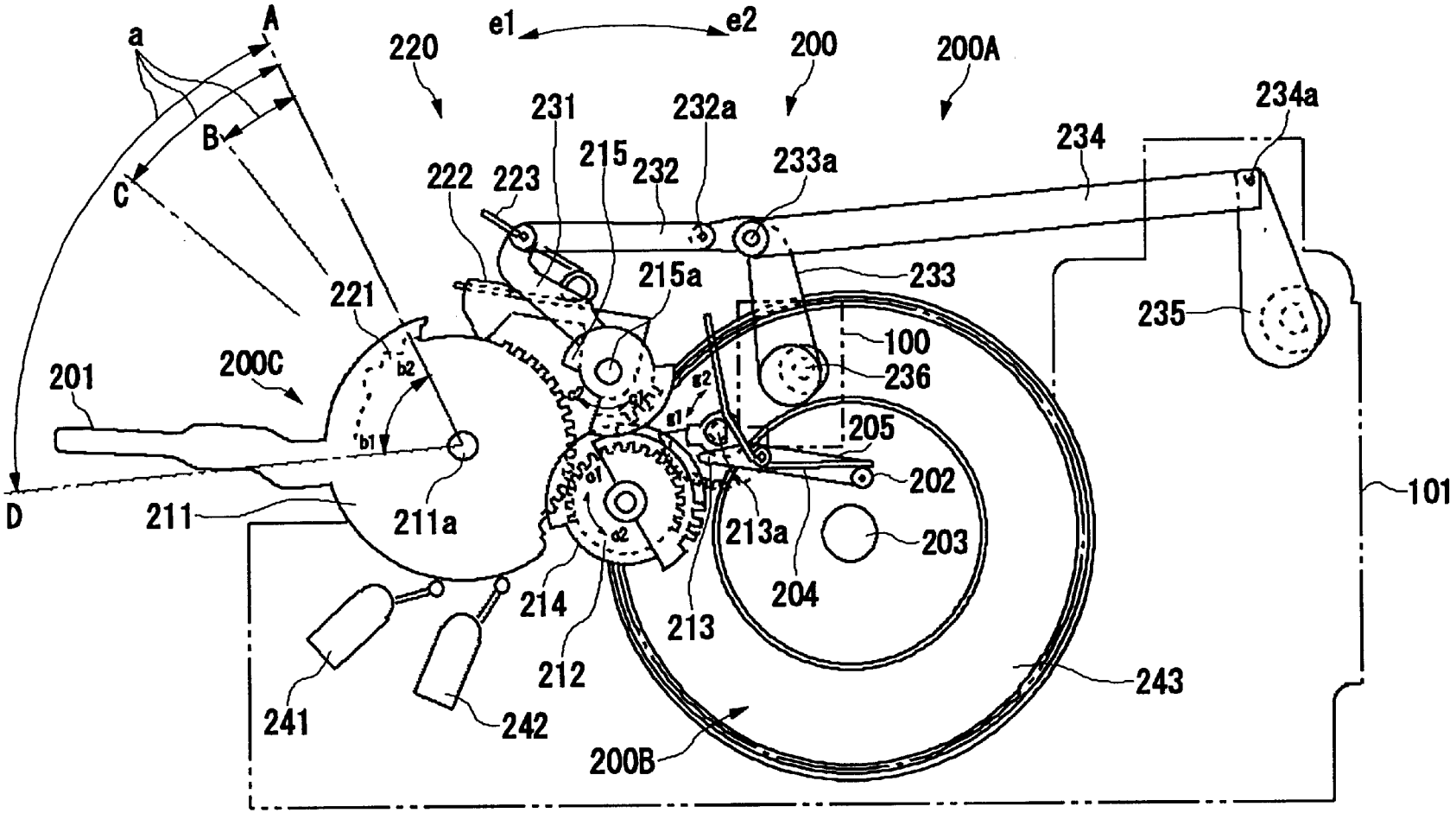
FIG. 6 is a side view showing a detailed example of a second state of the paper gap switching portion and the pressing-force adjustment portion in the ink jet printer shown in FIG. 1.
Figure 7:
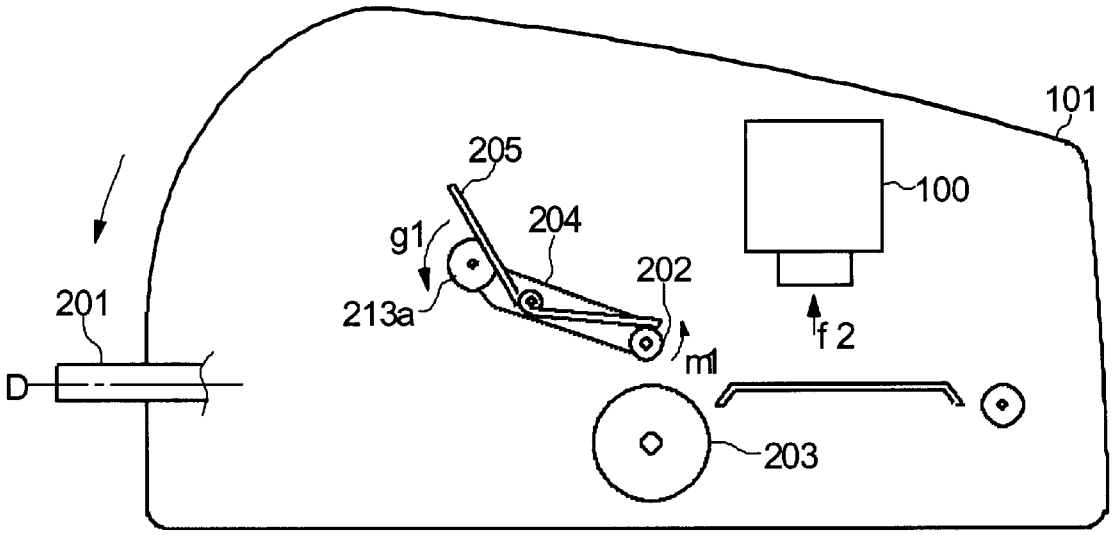
FIG. 7 is a side view showing a second example of an operation of the paper gap switching portion and the pressing-force adjustment portion in the ink jet printer shown in FIG. 1.

Next, in a state shown in FIG. 6, in which the operation lever 201 is moved from position A to be positioned at position D, the fourth intermittent gear 214 is first rotated together with the second intermittent gear 212 in direction c1 by rotation of the first intermittent gear 211 in direction b1. Furthermore, the fifth intermittent gear 215 is rotated in direction d1. Therefore, the respective links 231 to 235 as a whole rotate in direction e1, so that the print head 100 is moved in direction f1, that is, upward, as shown in FIG. 7.

During this operation, the third intermittent gear 213 starts to rotate in direction g1, as shown in FIG. 6. Thus, the coil spring 205 is brought into contact with the flat portion of the D-shaft 213*a*, so that the following roller 202 is released from the elasticity of the coil spring 205 and is therefore released from the paper-feeding roller 203 in direction m1. At this time, both the limit switches 241 and 242 are turned off, and the lamps 106 and 107 provided on the front-side of the body 101 as shown in FIG. 1 go on and off.

When the operation lever 201 is moved from position A to be positioned at position D, as shown in FIG. 6, the following roller 202 is released from the paper-feeding roller 203 in direction m1 and the print head 100 also moves upward in direction f1 to provide the maximum paper gap. Therefore, in this state, even the extra-thick paper, the tray for the information recordable disk or the like can be transported smoothly through the respective spaces between the components without interfering with the following roller 202 and the print head 100.

Figure 8:
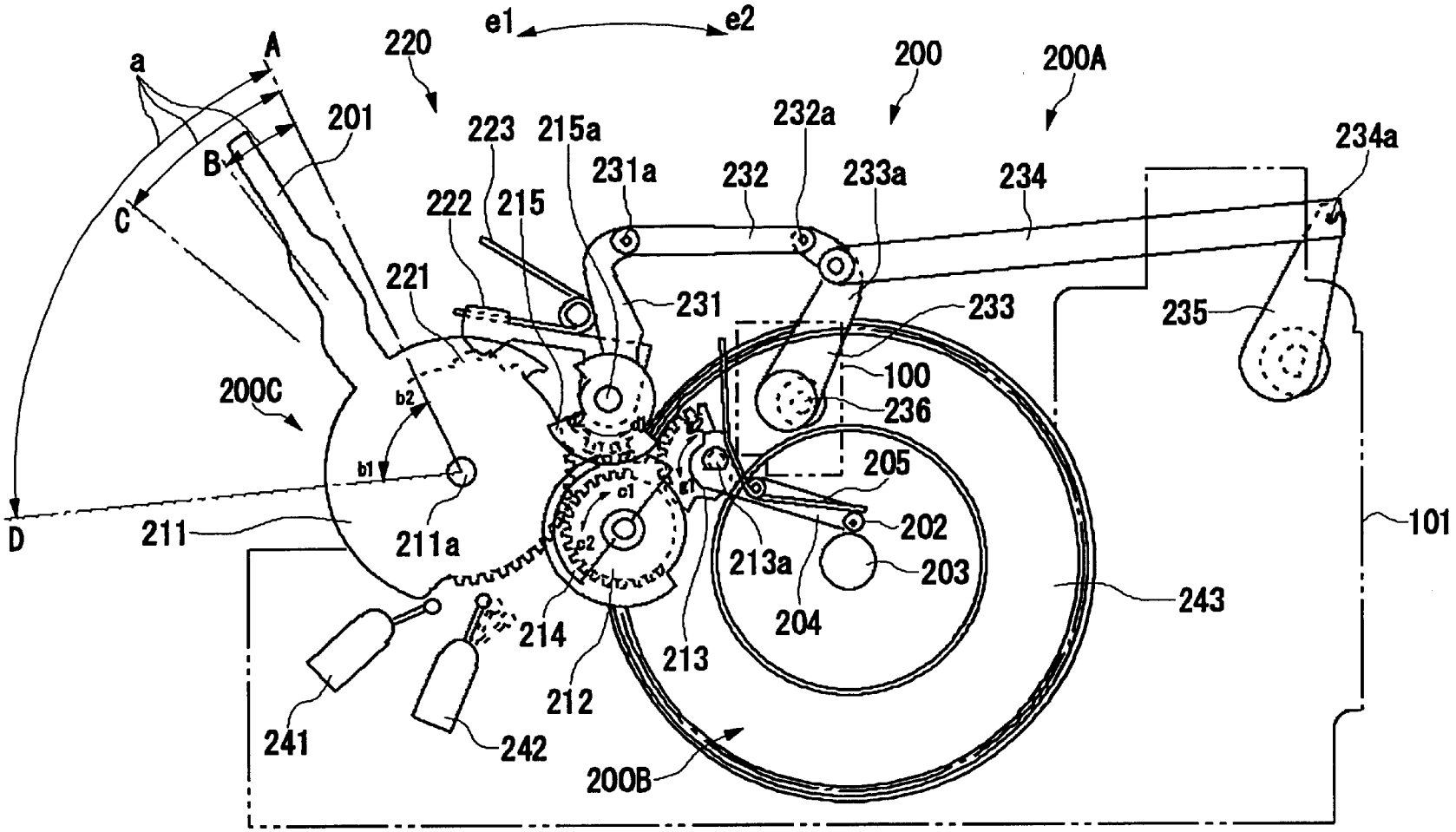
FIG. 8 is a side view showing a detailed example of a third state of the paper gap switching portion and the pressing-force adjustment portion in the ink jet printer shown in FIG. 1.
Figure 9:
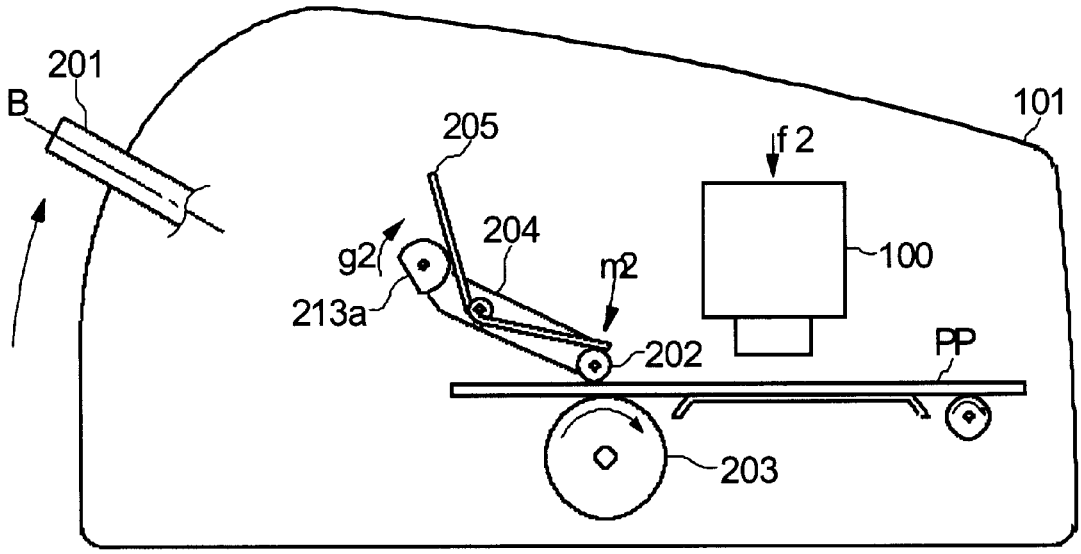
FIG. 9 is a side view showing a third example of an operation of the paper gap switching portion and the pressing-force adjustment portion in the ink jet printer shown in FIG. 1.

Next, in a state shown in FIG. 8, in which the operation lever 201 is moved from position D to be positioned at position B, the fourth intermittent gear 214 is rotated together with the second intermittent gear 212 in direction c2 by rotation of the first intermittent gear 211 in direction b2. Moreover, the fifth intermittent gear 215 also rotates in direction d2. Thus, the respective links 231 to 235 are rotated in direction e2, as shown in FIG. 8, and therefore the print head 100 is moved in direction f2, i.e., downward, as shown in FIG. 9.

In this state, the print head 100 is moved to a place at a position away from the position of the print head 100 for plain paper, shown in FIG. 5, by about 1.2 mm, since the thickness of the thick paper containing the variation is in the range of about 0.7 mm to 1.5 mm, for example. At the same time, the third intermittent gear 213 rotates in direction g2, as shown in FIG. 8, and the coil spring 205 is pressed by the D-shaft 213*a*, as shown in FIG. 9. Thus, the elasticity of the coil spring 205 is applied to the following roller 202 in such a manner that the following roller is moved in a rotating manner in direction m2 to press the thick paper PP that has been transported into the space between the rollers 202 and 203 against the paper-feeding roller 203. In this state, the limit switch 241 is turned off while the other limit switch 242 is turned on. Moreover, the lamp 106 provided on the front side of the body 101, as shown in FIG. 1, goes on and off, while the lamp 107 is lighted.

Figure 10:
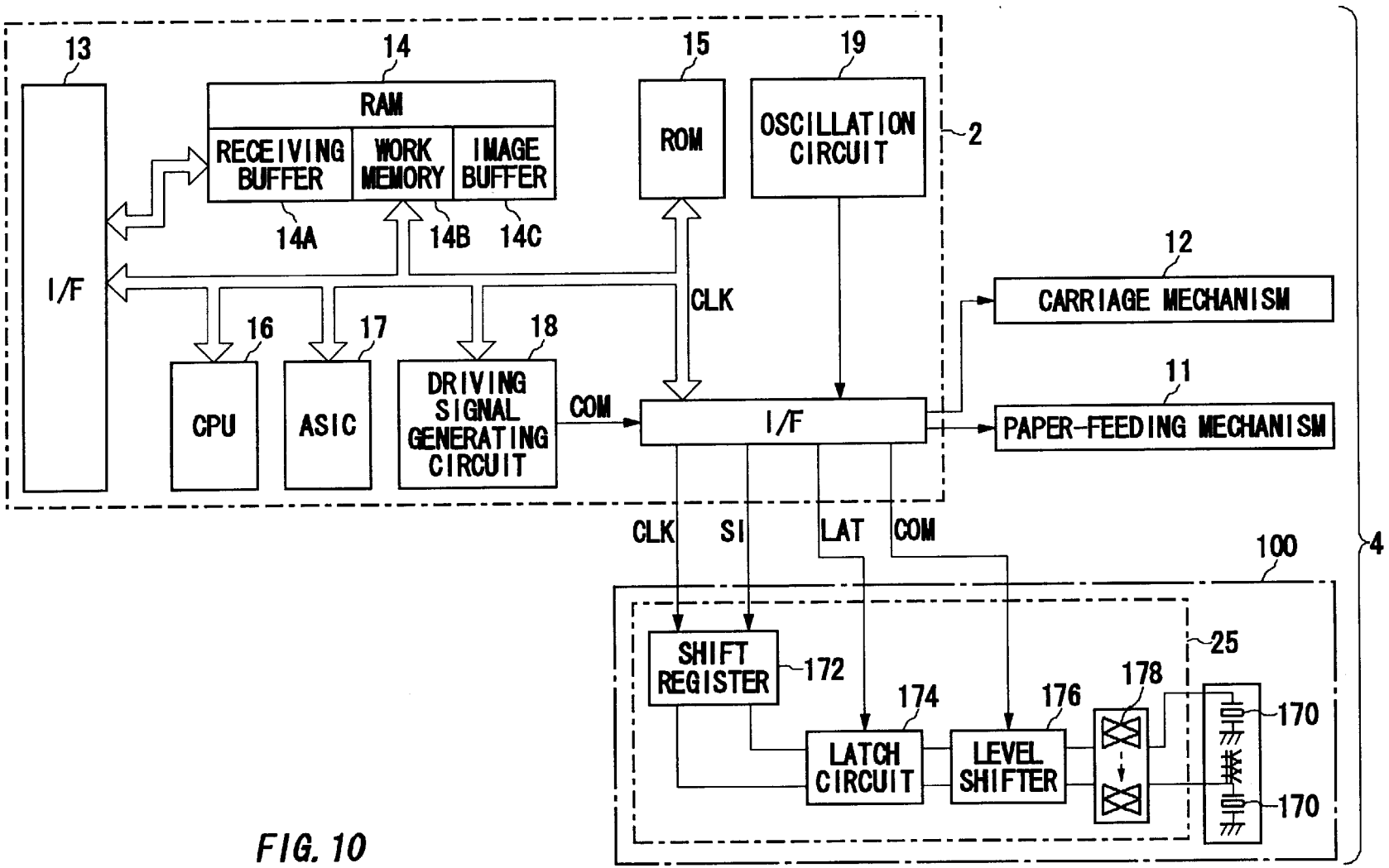
FIG. 10 shows a hardware configuration of a controlling system in the ink jet printer shown in FIG. 1.

When the printer is placed in this state, i.e., the state where the operation lever 201 is positioned at position B and the limit switch 242 is turned on, a main controlling unit of the printer receives an ON-signal issued by the limit switch 242 and performs the following control of the printing. FIG. 10 illustrates a hardware configuration of a controlling system in the ink jet printer shown in FIG. 1.

The ink jet printer of the present embodiment includes a printer controller 2 and a printer engine 4 that includes a carriage mechanism 12, a paper feeding mechanism 11 and the print head 100. The paper feed mechanism 11 is formed by a paper feeding motor (not shown), the paper-feeding roller 203 and the like, and successively feeds sheets of the printing paper P and then scans each sheet in the sub-scanning direction. The carriage mechanism 12 has at least a carriage (not shown) on which the print head 100 is mounted and a carriage motor (not shown) for making the carriage run via a timing belt (not shown), and scans each sheet with the print head 100 in the main scanning direction.

The printer controller 2 includes an interface 13 that receives printing data containing multi-coded layered information from a host computer (not shown) or the like, a RAM 14 that stores various kinds of data, such as the printing data containing the multi-value level information, a ROM 15 in which a routine or the like is stored for various kinds of data processing, a CPU 16, a print controlling ASIC (application-specific integrated circuit) 17, a driving signal generating circuit 18, an oscillation circuit 19, and an interface 20 having a function of transmitting the printing data SI that has been expanded to be dot-pattern data to the print head 100.

The print head 100 has a head driving circuit 25 and a plurality of pressure generating elements 170 that are formed by a plurality, ninety-six, for example, piezoelectric vibrators respectively connected to the head driving circuit 25. The head driving circuit 25 includes a plurality, ninety-six, for example, of shift registers 172 corresponding to the respective pressure generating elements 170, latch circuits 174, level shifters 176 and analog switches 178. The printer controller 2 entirely serves as the main controlling unit of the ink jet printer of the present embodiment. Moreover, a unidirectional printing portion of the ink jet printer of the present embodiment is constituted by at least one program for the unidirectional printing stored in the ROM 15, the RAM 14 in which the image data is expanded in order to perform the unidirectional printing, the CPU 16 and the like. Similarly, a bidirectional printing portion of the ink jet printer of the present embodiment is constituted by at least one program for the bidirectional printing stored in the ROM 15, the RAM 14 in which the image data is expanded in order to perform the bidirectional printing, the CPU 16 and the like.

The printing data containing the multi-value level information sent from the host computer or the like is held by a receiving buffer 14A via the interface 13. The printing data in the receiving buffer 14A is subjected to command analysis and is processed by the CPU 16 in such a manner that a printing position of each character, a type of decoration for the character, a character size, an address of a font and the like are added to the data. The CPU 16 then expands the analyzed data as image data for printing in an image buffer 14C, so that the image data is stored in the image buffer 14C. Moreover, in the RAM 14, a work memory (work area) 14B is provided to temporarily store various types of job data.

When the image data for printing that corresponds to one scan of the print head 100 has been obtained, the image data for printing is serial-transferred to the print head 100 via the interface 20. The print head 100 has a number of, for example, 96 nozzle openings arranged in the sub-scanning direction and makes the nozzle openings eject ink droplets at predetermined timings, respectively. The printing data after being expanded to the image data for printing in the printer controller 2 is serial-transferred from the interface 20 to the shift registers 172 in the head driving circuit 25 of the print head 100 in synchronization with a clock signal (CLK) from the oscillation circuit 19. The latch circuit 174 once latches the printing data (SI/printing data) thus transferred. The latched printing data SI is subjected to amplification by the level shifter 176 serving as a voltage amplifier up to a predetermined voltage that can drive the corresponding analog switch 178, for example, several tens of volts. The printing data SI after being amplified is supplied to the corresponding analog switch 178.

Moreover, a driving signal COM from the driving signal generating circuit 18 is applied to an input end of each analog switch 178 of the head driving circuit 25, while an output end thereof is connected to the corresponding piezoelectric vibrator serving as the pressure generating element 170.

The printing data SI controls the operation of the analog switches 178. For example, in a period in which a data unit of the printing data corresponding to each analog switch 178 is "1", the driving signal COM is applied to the piezoelectric vibrator 170 associated with the analog switch 178, so that the piezoelectric vibrator 170 vibrates in accordance with the driving signal COM. Thus, the pressure is applied to ink in the pressure generating chamber, thereby ejecting the ink droplets via the nozzle opening. On the other hand, in a period in which the data unit of the printing data corresponding to each analog switch is "0", the supply of the driving signal COM to the piezoelectric vibrator is stopped. Thus, the ink droplets cannot be ejected.

Figure 11:
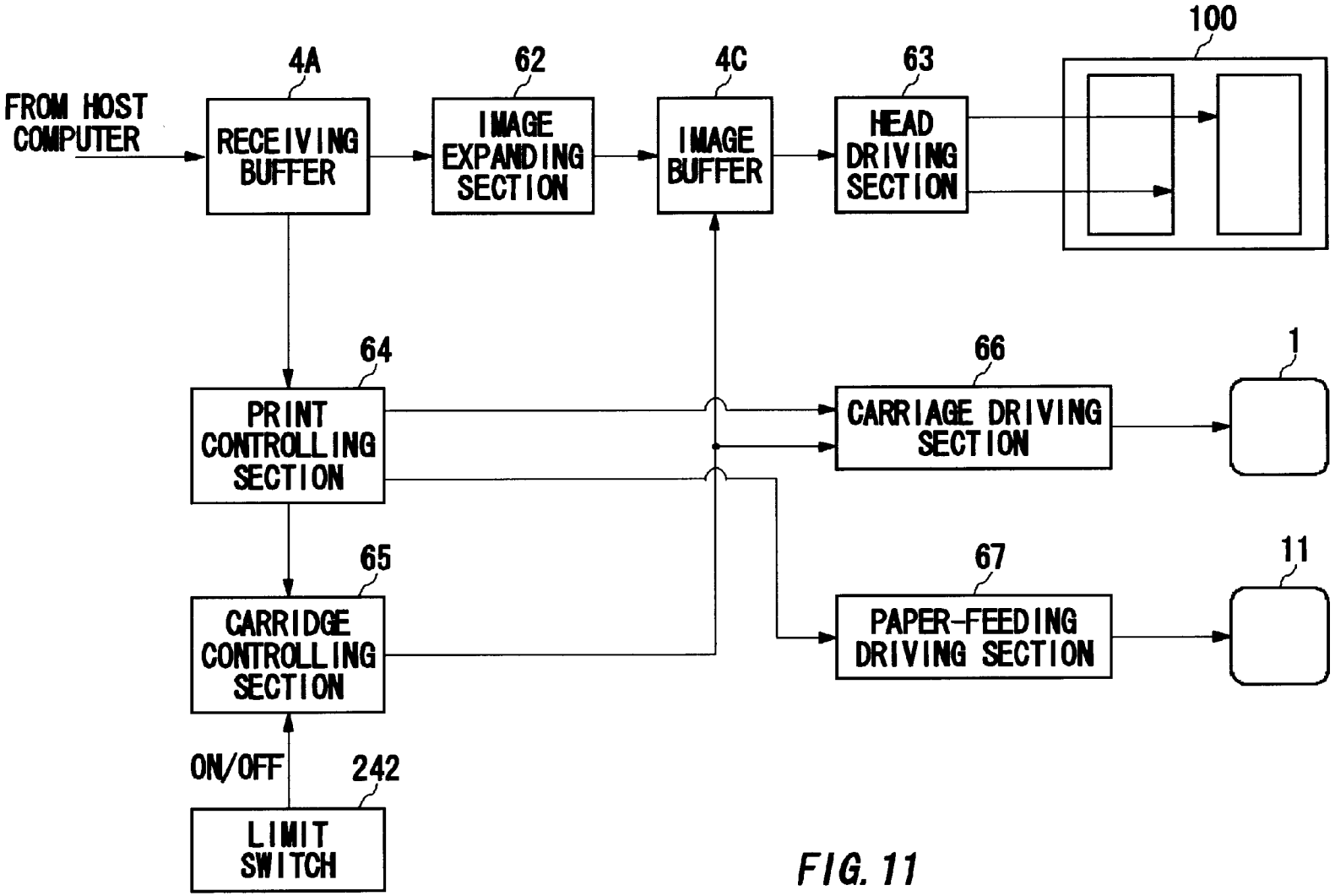
FIG. 11 is a diagram schematically showing a structure of a printing-mode controlling device in the ink jet printer shown in FIG. 1.

FIG. 11 is an exemplary functional diagram of a printing-mode controlling device in the ink jet printer according to the present embodiment.

In the printing-mode controlling device, an image expanding section 62 expands the printing data, contained in the data stored in the aforementioned receiving buffer 4A, as the image data for printing in the image buffer 4C. In accordance with the image data for printing, the head driving section 623 drives the print head 100. A print controlling section 64 controls a carriage driving section 66 and a paper-feeding driving section 67 by means of a carriage controlling section 65, to form ink dots corresponding to the image data for printing by the print head 100. The carriage controlling section 65 determines which one of the unidirectional printing and the bidirectional printing is selected by the user, and controls the speed of the carriage motor (including the direction of the rotation) in accordance with the determination result.

The carriage controlling section 65 further determines whether or not the image data for printing that was expanded in the image buffer 4C is data for which the bidirectional printing can be performed. When determining that the bidirectional printing can be performed, even if the user's selected printing mode is the unidirectional printing, the carriage controlling section 65 switches the printing mode to the bidirectional printing. Moreover, the carriage controlling section 65 monitors the signal from the aforementioned limit switch 242. When the signal from the limit switch 242 turns on, the carriage controlling section 65 switches the printing mode to the unidirectional printing by force, even if the user's selected printing mode is the bidirectional printing and the image data for printing is the data for which the bidirectional printing can be performed.

Figure 12:
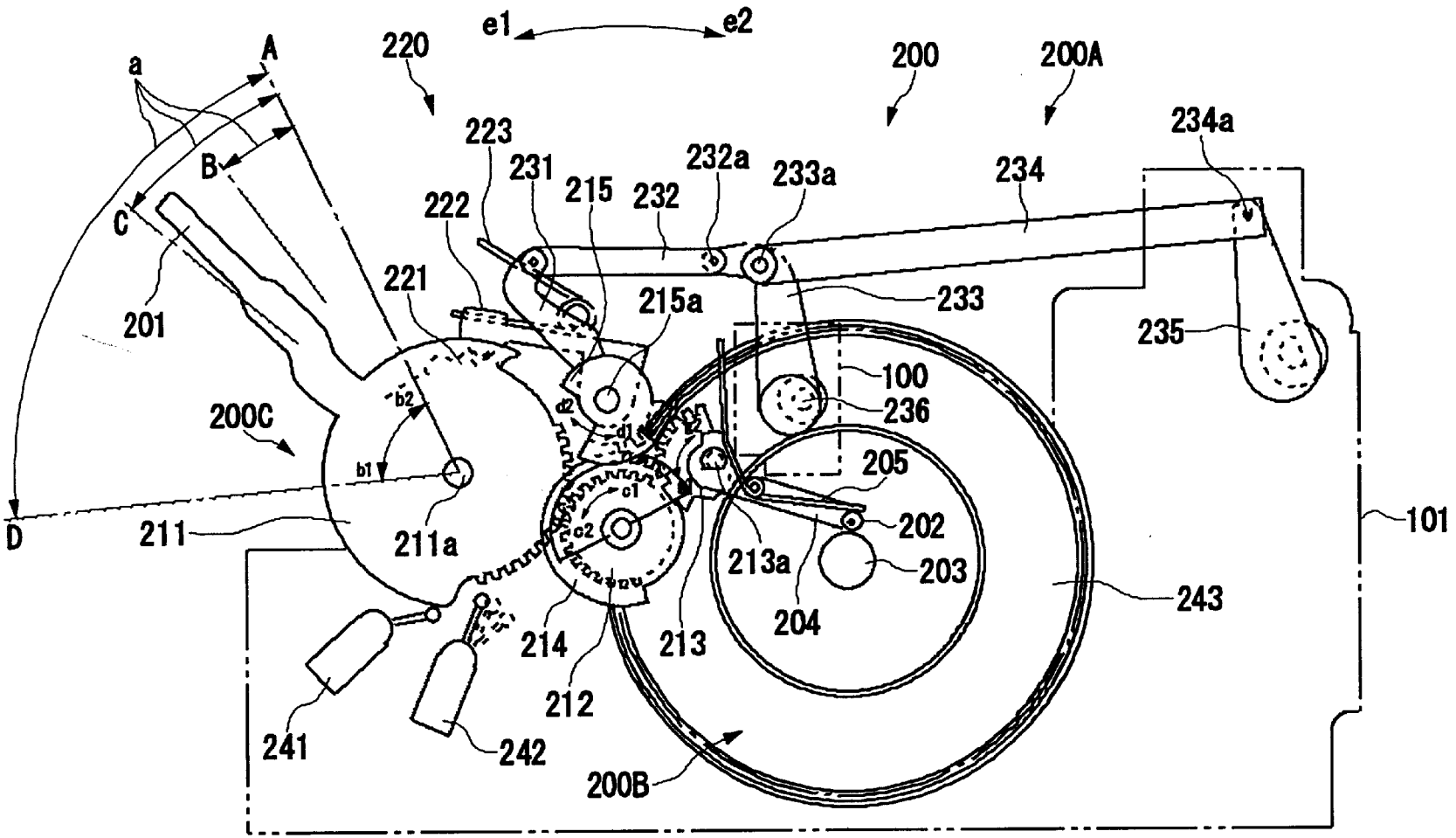
FIG. 12 is a side view showing a detailed example of a fourth state of the paper gap switching portion and the pressing-force adjustment portion in the ink jet printer shown in FIG. 1.

Next, in a state shown in FIG. 12, in which the operation lever 201 is moved from position D to position at position C, the fourth intermittent gear 214 is rotated in direction c2 together with the second intermittent gear 212 by rotation of the first intermittent gear 211 in direction b2. Also, the fifth intermittent gear 215 rotates in direction d2. Thus, the respective links 231 to 235 rotate in direction e2, as shown in FIG. 12, so that the print head 100 is moved in direction f2, i.e., downward, as shown in FIG. 11.

Figure 13:
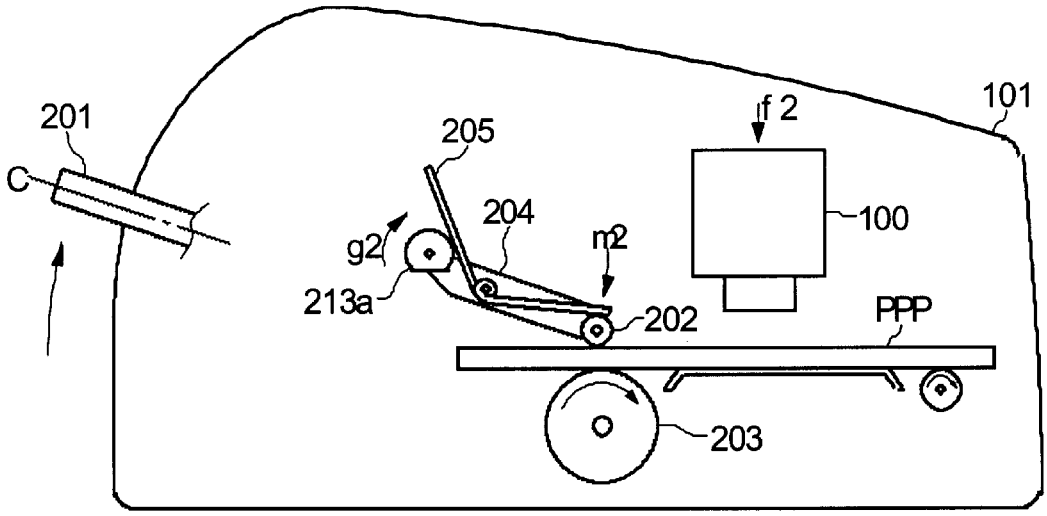
FIG. 13 is a side view showing a fourth example of an operation of the paper gap switching portion and the pressing-force adjustment portion in the ink jet printer shown in FIG. 1.

In this state, the print head 100 is moved to place at a position away from the position of the print head 100 for the plain paper shown in FIG. 5 by about 2.5 mm, because the thickness of the extra-thick paper containing variation is in the range of about 1.6 mm to 2.5 mm. At the same time, the third intermittent gear 213 rotates in direction g2, as shown in FIG. 12, so that the coil spring 205 is pressed by the D-shaft 213*a*, as shown in FIG. 13. Thus, the elasticity of the coil spring 205 that is pressed by the D-shaft 213*a* is applied to the following roller 202 in such a manner that the following roller 202 is rotated in direction d2 to press the extra-thick paper PPP that was transported to the space between the rollers 202 and 203. In this state, the limit switch 241 is turned off, while the limit switch 242 is turned on. Thus, the lamp 106 provided on the front side of the body 101 goes on and off, while the other lamp 107 is lighted.

After the lamp 107 is lighted, the system performs the similar control to that when the operation lever 201 is positioned at position B.

Figure 14:
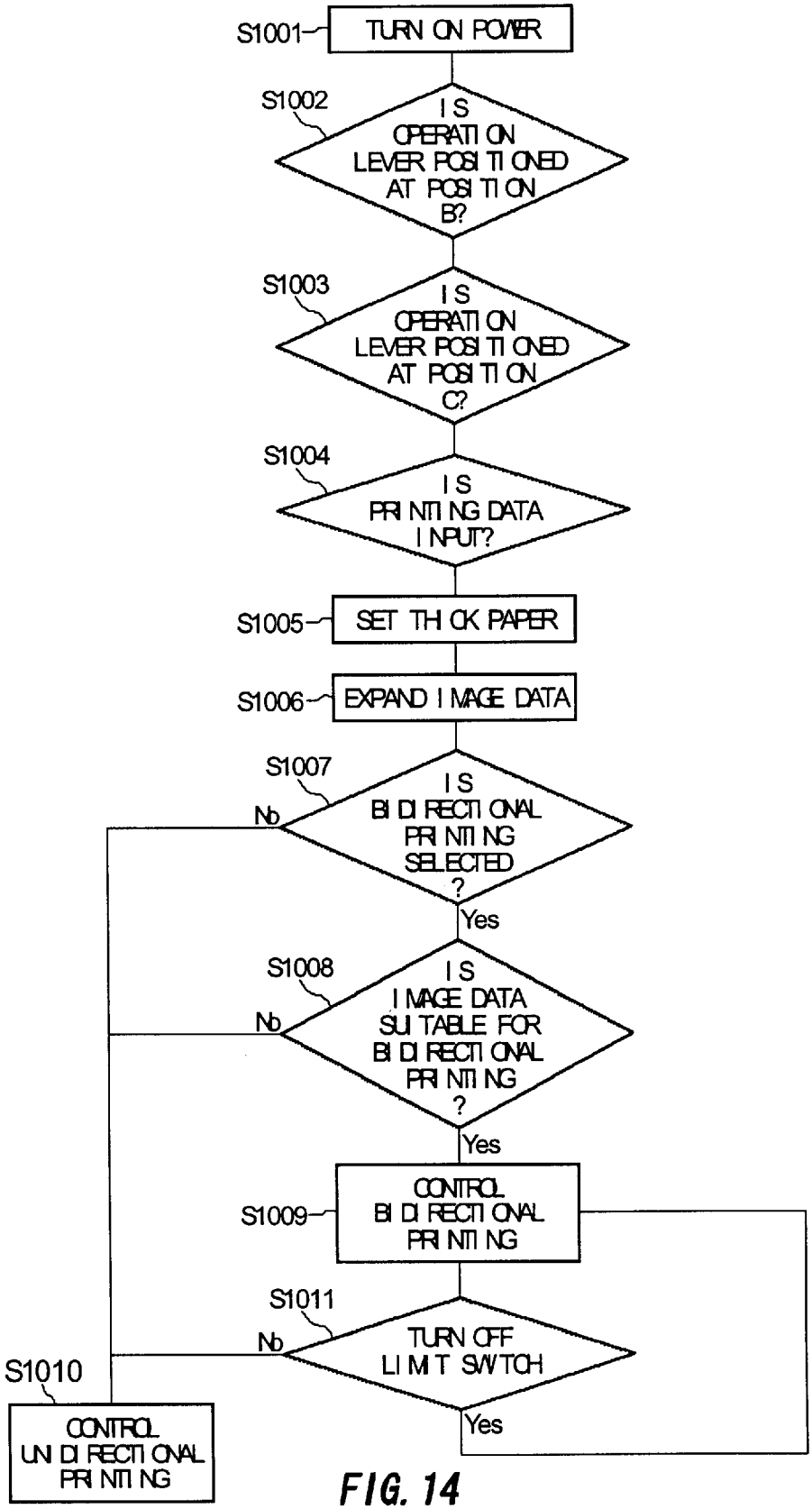
FIG. 14 is a flowchart of a printing-mode controlling operation in the ink jet printer shown in FIG. 1.

The operation of the device having the aforementioned structure is described based on a flowchart shown in FIG. 14.

When the power of the printer is turned on (Step S1001), it is determined whether the user switches the operation lever 201 at position B (Step S1002). When it is determined that the operation lever 201 is positioned at position B in Step S1002, it is then determined whether or not the operation lever 201 is positioned at position C after the thick paper has been manually inserted via the paper feed-in opening 103, or after the extra-thick paper has been manually inserted via the paper feed-in opening 103 after the operation lever 201 was positioned at position D to release the following roller 202 (Step S1003). In a case of Yes in Step S1003, it is then determined whether or not the printing data is input from the host computer (Step S1004). When it is determined that the printing data has been input, the print controlling section 64 sets the thick paper or the extra-thick paper to a predetermined position (Step S1005). Also, the image expanding section 62 expands the printing data as the image data for printing in the image buffer 64 (Step S1006).

Then, the carriage controlling section 65 determines whether the user has selected the bidirectional printing (Step S1007). In a case where the bidirectional printing which gives much weight to the printing speed is determined to be selected, such as a case of printing characters, it is further determined whether or not the image data for printing that was expanded in the image buffer 4C is suitable for the bidirectional printing (Step S1008). When the image data for printing is suitable for the bidirectional printing, the carriage controlling section 65 controls the speed of the carriage motor (including the direction of the rotation) to perform the bidirectional printing (Step S1009). On the other hand, in a case where the unidirectional printing is determined to be selected in Step S1007, or in a case where the image data for printing that was expanded in the image buffer 40 is not determined to be suitable for the bidirectional printing in Step S1008, the carriage controlling section 65 controls the speed of the carriage motor (including the direction of the rotation) to perform the unidirectional printing (Step S1010).

Moreover, the carriage controlling section 65 monitors the signal from the limit switch 242 as described before (Step S1011), and switches the printing mode to the unidirectional printing by force (S1010) when the signal from the limit switch 242 is turned on, even if the user selected the bidirectional printing as the printing mode.

On the other hand, the signal from the limit switch 242 is determined to be off in Step S1011, the carriage controlling section 65 continues to perform the bidirectional printing (Step S1009).

As described above, in the ink jet printer of the present embodiment, only by operating a single operation lever 201 that switches the different paper gaps by moving the ink jet print head 100 to be positioned at position B for the thick paper or position C for the extra-thick paper, the limit switch 242 is turned on because of its mechanism. When receiving the ON-signal from the limit switch 242, the main controlling unit of the printer prohibits the bidirectional printing and performs the unidirectional printing by force even if the user specifies the bidirectional printing on the printer driver or an operation panel of the printer.

In other words, the printer is arranged to allow the selection of the unidirectional printing and the bidirectional printing. Although the user selected the bidirectional printing, when the thickness of the recording medium is out of a predetermined range and/or when the second paper gap has been set, the printing data generated for the bidirectional printing is expanded again to obtain the data for the unidirectional printing, thereby forcing the unidirectional printing only.

Thus, in a case of printing for the thick paper or the extra-thick paper while the user selected the bidirectional printing on the printer driver, for example, if the printer received the printing data for the bidirectional printing from the host computer, the received printing data is expanded again to be data for the unidirectional printing and then the unidirectional printing is performed. Therefore, the unidirectional printing automatically takes place without switching the printing mode to the unidirectional printing by the user on the printer driver, so that the printing quality can be prevented from being degraded without fail.

Accordingly, even in a case where relatively thin thick paper is used and therefore the paper gap becomes large, there occurs no dot-position shift between two directions in the bidirectional printing, preventing the printing quality from degrading Thus, even in a case where the thickness of the thick paper is varied depending on the type of the thick paper, the stable printing quality is achieved.

Furthermore, only by operating and positioning a single operation lever 201 at position B for the thick paper or at position C for the extra-thick paper, the bidirectional printing can be prohibited automatically. Therefore, it is not necessary for the user to select the printing mode on the printer driver or the operation panel every time the user manually inserts the recording medium having different thickness into the paper feed-in opening 103, thus realizing excellent operability. In addition, it is very convenient that the adjustment of the paper gaps and the determination of the printing mode are performed at the same time.

Figure 15:
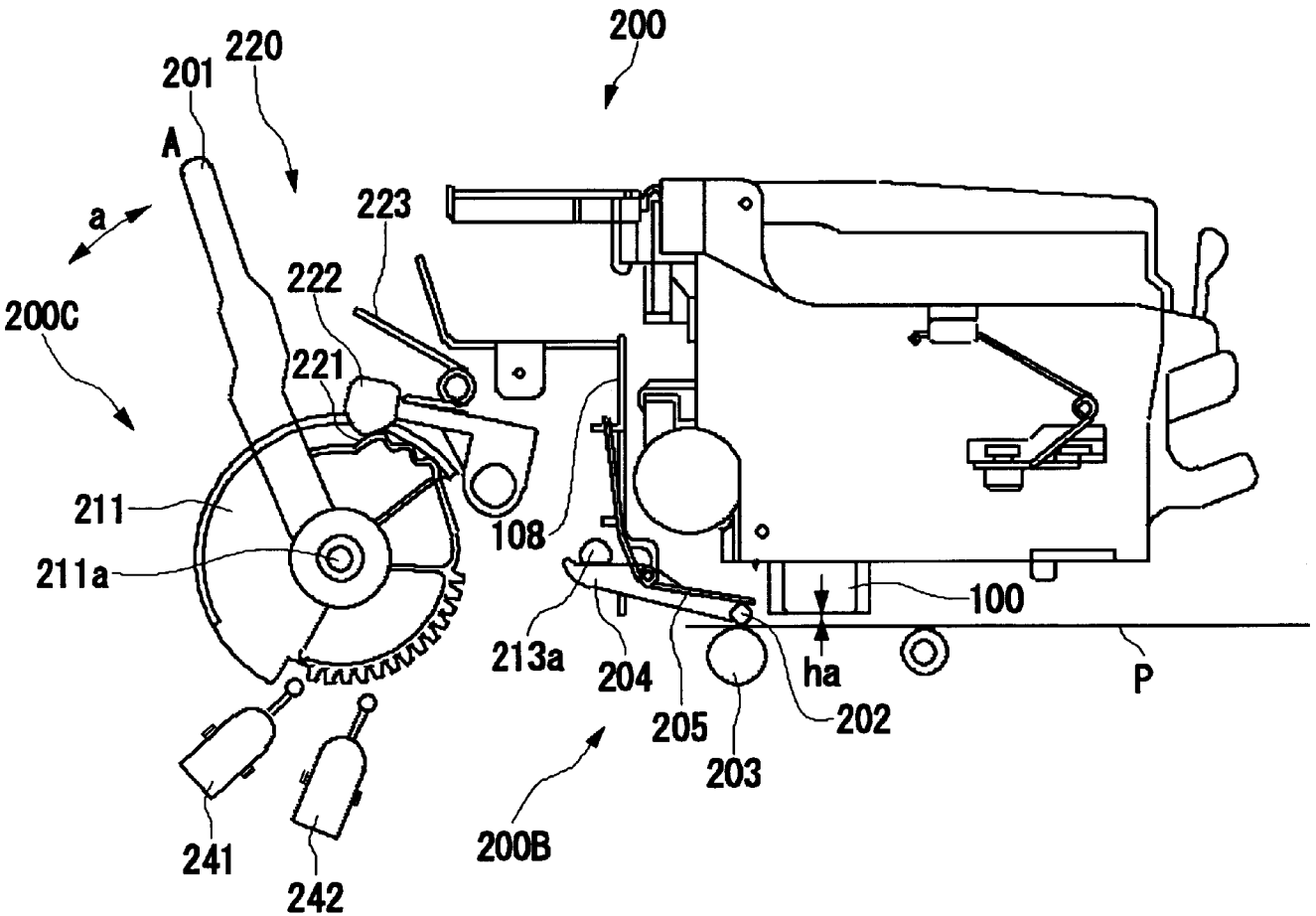
FIG. 15 is a side view showing a detailed example of a first state of another paper gap switching portion/pressing-force adjustment portion in the ink jet printer shown in FIG. 1.

FIG. 15 is a cross-sectional view of the printer illustrating another example of the paper gap switching portion/pressing-force adjustment portion 200 in detail. The paper gap switching portion/pressing-force adjustment portion 200 shown in FIG. 15 has the same components as that shown in FIG. 4, but parts of the components of the pressing-force adjustment portion 200B are arranged in a different manner from that shown in FIG. 4. FIG. 15 shows parts of the operation member 200C and the pressing-force adjustment portion 200B and the print head 100 only. The remaining parts of the operation member 200C and the pressing-force adjustment portion 200B, and the paper gap switching portion 200A are omitted in FIG. 15. In addition, the same components are labeled with the same reference numerals or signs in FIGS. 4 and 15.

The pressing-force adjustment portion 200B shown in FIG. 15 includes the fourth intermittent gear (not shown) having the shaft 213*a* in which part of a circumferential part is formed to be flat, the fifth intermittent gear (not shown), the following roller arm 204 with the following roller 202 rotatably mounted onto its one end, and the coil spring 205. Those components are respectively the same as the corresponding components of the pressing-force adjustment portion 200B shown in FIG. 4, but are arranged in a different manner as follows.

In the pressing-force adjustment portion 200B shown in FIG. 4, the shaft 213*a* presses one end of the coil spring 205 by its rotation, so that the other end of the coil spring 205 presses the following roller 202 mounted onto one end of the following roller arm 204 against the paper-feeding roller 203. Then, the shaft 213*a* further rotates, so that the pressure applied to the end of the coil spring 205 is released. Thus, the pressure applied to the other end of the coil spring 205 is also released, thereby releasing the following roller 202 from the paper-feeding roller 203.

On the other hand, in the pressing-force adjustment portion 200B shown in FIG. 15, one end of the coil spring 205 is fixed to a frame 108 of the body in advance, while the other end of the coil spring 205 presses the following roller 202 mounted on one end of the following roller arm 204 against the paper-feeding roller 203 by resilient force of the coil spring 205. Then, the other end of the following roller arm 204 is pressed by the rotation of the shaft 213*a*, so that the following roller 202 moves the other end of the coil spring 205 upwards to be released from the paper-feeding roller 203.

The operation member 200C includes the first intermittent gear 211 having the operation lever 201, and the second and third intermittent gears (both not shown). These components of the operation member 200C are the same as the corresponding ones in FIG. 4, and the arrangement of the components of the operation member 200C is also the same as that of the components in FIG. 4. The operation lever 201 is integrally formed with the first intermittent gear 211 so as to project from the circumferential part of the first intermittent gear 211, and can rotate in a reciprocating manner around the shaft 211*a* of the first intermittent gear 211 in direction a shown with arrow in FIG. 15. On the first intermittent gear 211, a wave-like ratchet tooth 221 serving as a click mechanism 220 is formed integrally with the gear 211. Depressions of the wave-like ratchet tooth 221 are formed to correspond to positions A, B, C and D at which the operation lever 201 pivotally moved to be positioned. Moreover, a ratchet 222 of the click mechanism 220 is pressed against the ratchet tooth 221 by the coil spring 223.

Thus, when the user rotates the operation lever 201 to position it at each of positions A, B, C and D, the ratchet 222 fits into the corresponding depression of the wave-like ratchet tooth 221, like the operation member 200C shown in FIG. 4. Therefore, the user can recognize by excellent touch of click that the operation lever 201 is positioned at the desired one of the positions A, B, C and D without fail.

Positions A, B and C of the operation lever 201 for the adjustment of the paper gaps are arranged in such a manner that they are relatively close to each other. Position D of the operation lever 201 at which the following roller 202 is released from the paper-feeding roller 203, however, is arranged to be apart from Positions A, B and C by predetermined distances, respectively. Thus, when the user operates the operation lever 201, the user can recognize visually or by the physical sensation whether the paper gap is adjusted or the following roller 202 is released from the paper-feeding roller 203, thus preventing wrong operations.

In the above structure, the operations of the above-mentioned components are described referring to FIGS. 12 to 15. In a state shown in FIG. 15, in which the operation lever 201 is positioned at the position A, resilience of the coil spring 205 is applied to the following roller 202 so as to press plain paper P transported into the space between the paper-feeding roller 203 and the following roller 202. The print head 100 is moved to provide the paper gap ha that corresponds to the plain paper P.

In this state, the print head 100 is moved and adjusted to realize the paper gap ha of about 1.2 mm, for example, because the typical thickness of the plain paper containing the variation is about 0.6 mm or less. Both the limit switches 241 and 242 in this state are turned on, and the lamps 106 and 107 provided on the front side of the body 101, shown in FIG. 1, are lighted.

Figure 16:
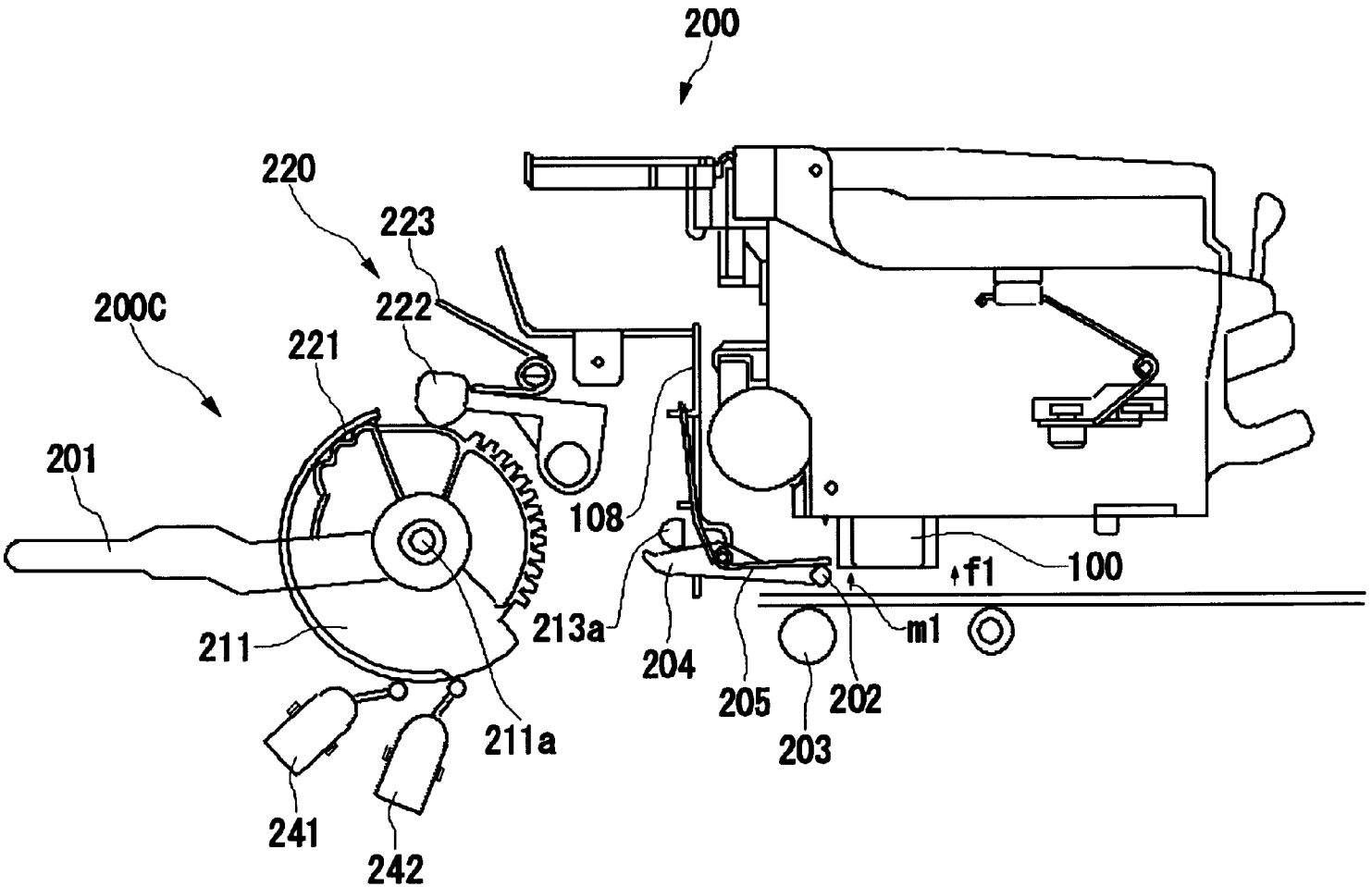
FIG. 16 is a side view showing a detailed example of a second state of the other paper gap switching portion/pressing-force adjustment portion in the ink jet printer shown in FIG. 1.

Next, in a state shown in FIG. 16, in which the operation lever 201 is moved from position A and then positions at position D, the print head 100 is moved in direction f1, that is, upward, by rotation of the first intermittent gear 211. Moreover, during this operation, since the circumferential part of the D-shaft 213*a* presses one end of the following roller arm 204 down, the other end of the following roller arm 204 is raised, thereby the following roller 202 is released from the paper-feeding roller 203 in direction m1. At this time, both the limit switches 241 and 242 are turned off, and the lamps 106 and 107 provided on the front-side of the body 101 as shown in FIG. 1 go on and off.

When the operation lever 201 is moved from position A and is then positioned at position D, as shown in FIG. 16, the following roller 202 is released from the paper-feeding roller 203 in direction m1, and the print head 100 also moves upward in direction f1 to provide the maximum paper gap. Therefore, in this state, even the extra-thick paper, the tray for the information recordable disk or the like can be transported smoothly through the respective spaces between the components without interfering with the following roller 202 and the print head 100.

Figure 17:
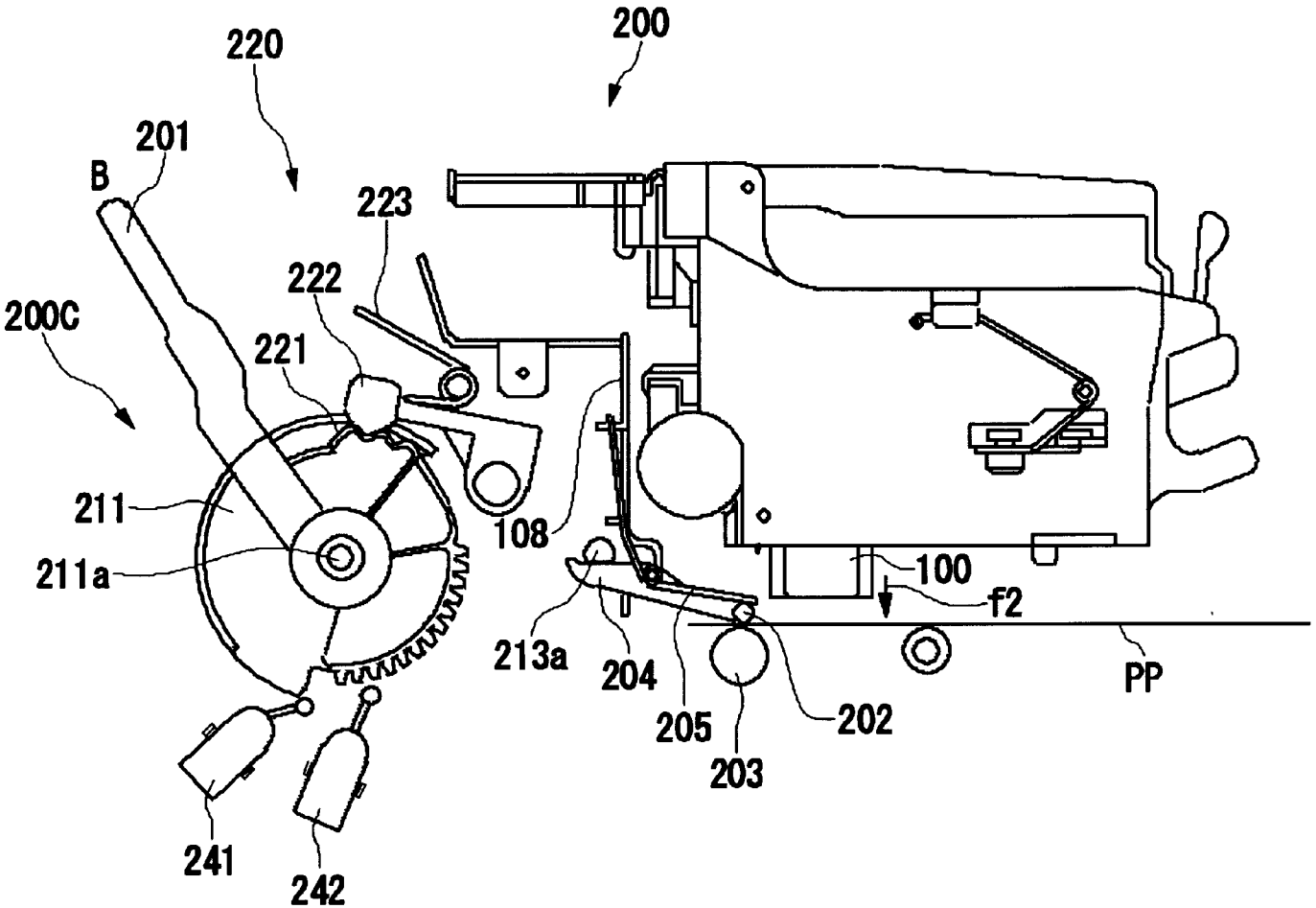
FIG. 17 is a side view showing a detailed example of a third state of the other paper gap switching portion/the pressing-force adjustment portion in the ink jet printer shown in FIG. 1.

Next, in a state shown in FIG. 17, in which the operation lever 201 is moved from position D to be positioned at position B, the print head 100 is moved in direction f2, that is, downward, by rotation of the first intermittent gear 211. In this state, the print head 100 is placed at a position away from the position of the print head 100 for plain paper, shown in FIG. 12, by about 1.2 mm, since the thickness of the thick paper including variation is in the range of about 0.7 mm to 1.5 mm, for example.

At the same time, one end of the following roller arm 204 is pressed down by resilience of the coil spring 205 since the other end of the following roller arm 204 is brought into contact with the flat portion of the D-shaft 213*a*. Thus, the following roller 202 presses the thick paper PP that has been transported into the space between the rollers 202 and 203 against the paper-feeding roller 203. In this state, the limit switch 241 is turned off while the other limit switch 242 is turned on. Moreover, the lamp 106 provided on the front side of the body 101 as shown in FIG. 1 goes on and off, while the lamp 107 is lighted.

Figure 18:
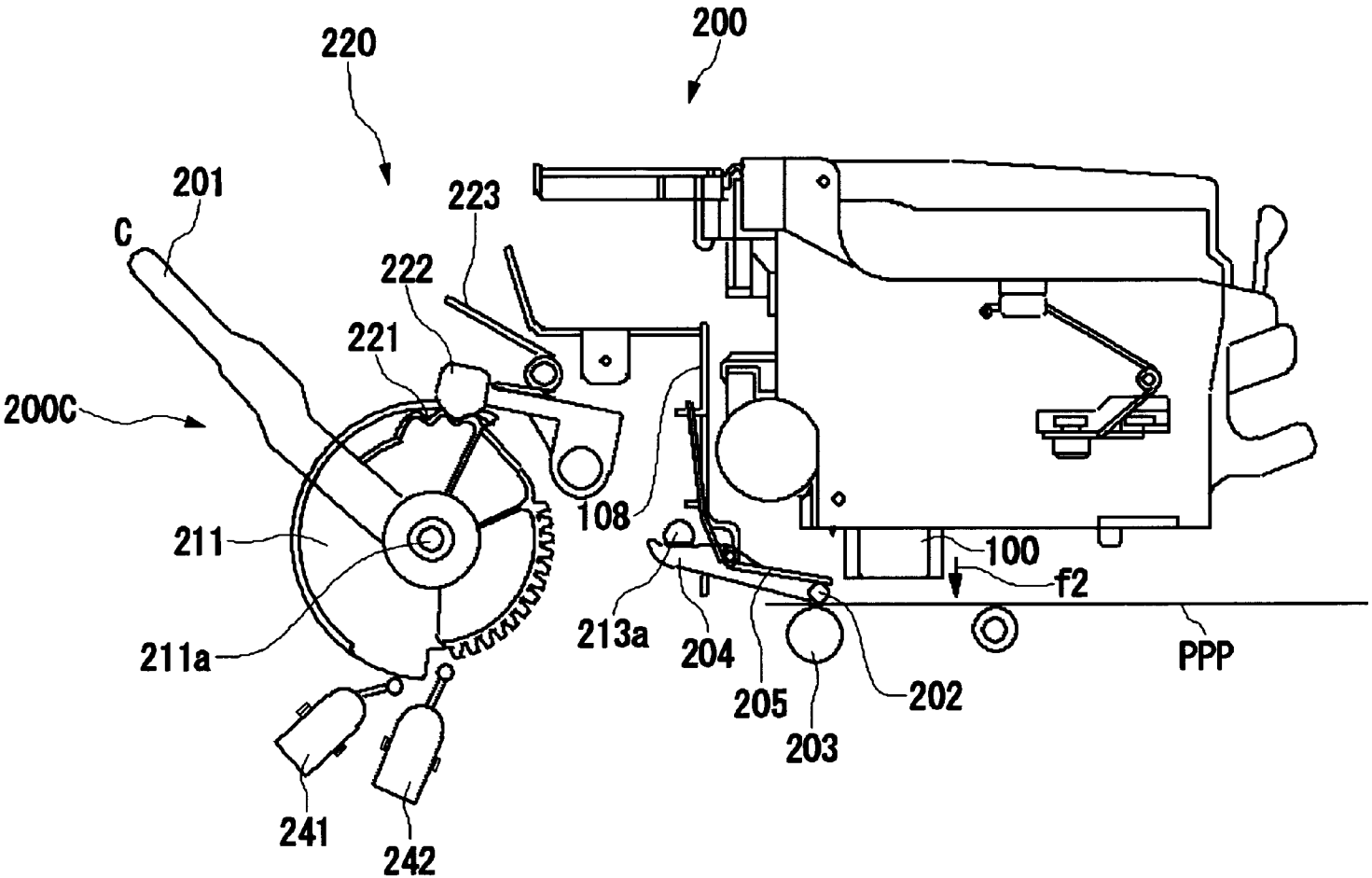
FIG. 18 is a side view showing a detailed example of a fourth state of the other paper gap switching portion/the pressing-force adjustment portion in the ink jet printer shown in FIG. 1.

In a state shown in FIG. 18, in which the operation lever 201 is moved from position D to be positioned at position C, the print head 100 is moved in direction f2, that is, downward, by rotation of the first intermittent gear 211. In this state, the print head 100 is moved to place at a position away from the position for plain paper shown in FIG. 15 by about 2.5 mm, because the thickness of the extra-thick paper is in the range of about 1.6 mm to 2.5 mm, considering the thickness variation.

Moreover, as in the state shown in FIG. 17, one end of the following roller arm 204 is brought into contact with the flat portion of the D-shaft 213*a* while the other end of the following roller arm 204 is pressed down by the resilience of the coil spring 205. The following roller 202 presses the extra-thick paper PPP that has been transported into the space between the rollers 202 and 203 against the paper-feeding roller 203. Furthermore, in this state, the limit switch 241 is turned off whereas the limit switch 242 is turned on. Thus, the lamp 106 goes on and off whereas the lamp 107 is lighted.

In the ink jet printer of the above embodiments, the paper gap switching portion 200A for moving the print head 100 so as to switch the different paper gaps and the pressing-force adjustment portion 200B for applying the pressure to the following roller 202 or releasing the applied pressure so as to adjust the pressing force applied to sheets of printing paper having different thicknesses are provided. According to the present invention, two series of operations, i.e., the switching and adjustment operations for the paper gap switching portion 200A and the pressing-force adjustment portion 200B can be mechanically performed by components having simple structures, i.e., the second and third intermittent gear 212 and 214 that are connected to the single operation lever 201 serving as the operation member 200C. Thus, it is possible to perform the switching/adjustment operations with high accuracy without fail.

In other words, by moving the one operation lever 201, the switching of the paper gaps for the print head 100 by the paper gap switching portion 200A can be performed via the second and third intermittent gears 212 and 214. Also, the switching between the pressure application to the following roller 202 and the pressure release from the following roller 202 can be smoothly performed in the step-like manner by operating the operation lever 201 via the second and third gears 212 and 214. Moreover, since the operation member 200C, the paper gap switching portion 200A and the pressing-force adjustment portion 200B are formed by a gear mechanism and a link mechanism, they can be implemented by simple mechanisms.

Although the present invention is described in the above referring to various embodiments, the present invention is not limited to the above embodiments, but other embodiments within the scope of the invention defined by the claims can be considered. For example, the second and third intermittent gears 212 and 214 used for switching the two series of the driving operations for the paper gap switching portion 200A and the pressing-force adjustment portion 200B may be jointed with each other to have the same rotation axis, after being fabricated as separate parts. Alternatively, they may be integrally fabricated.

In the above embodiments, a case was described where four switching positions of the operation lever 201 are set, that include position A for plain paper that is recording paper having a typical thickness; position B for thick paper that is slightly thicker than the plain paper; position C for extra-thick paper, including the tray for the information recordable disk, that is considerably thicker than the plain paper; and position D at which the following roller 202 is released from the paper-feeding roller 203. However, the switching positions of the operation lever 201 are not limited to the above case. The present invention can be applied to the printer, as long as at least three positions including position P that provides the first head gap, position Q that provides the second head gap larger than at least the first head gap, and position R at which the following roller 202 is released from the paper-feeding roller 203 are set.

Figure 19:
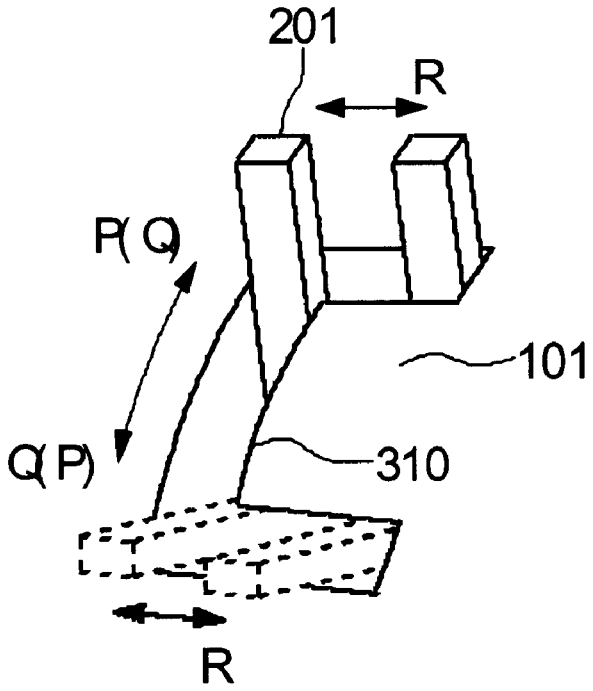
FIG. 19 is a perspective view showing a modification of an operation lever in the ink jet printer shown in FIG. 1.

In the above embodiments, positions A, B, C and D were arranged in that order. However, the present invention can be applied to a case where the switching positions are arranged in an arbitrary order. For example, in the case of setting the switching positions to be positions P, Q and R described above, positions P, Q and R may be arranged in an order of P, Q and R, in another order of R, P and Q and in still another order of P, R and Q. Moreover, as shown in FIG. 19, positions P and Q may be arranged on a slit 310 that is a C-shaped groove formed on the body 101 of the ink jet printer, in such a manner that one of positions P and Q is set to an upper position than the other. Position R is provided at one side of each of positions P and Q, as shown in FIG. 19. In this case, the switching to the release of the following roller 202 from the paper-feeding roller 203 can be performed more quickly.

Figure 20A:
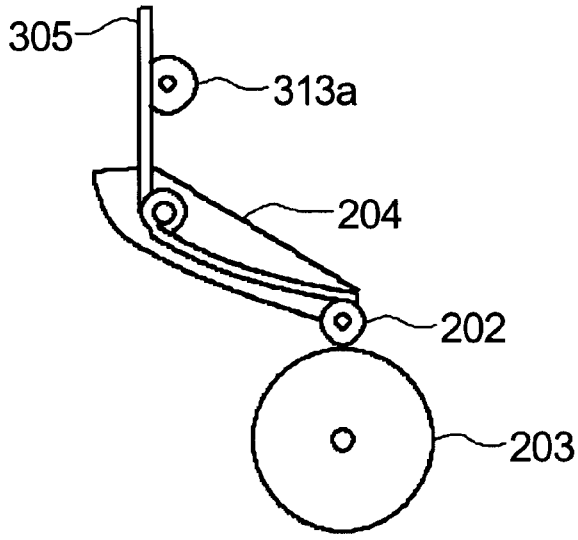
FIGS. 20A and 20B are side views showing a modification of the pressing-force adjustment portion in the ink jet printer shown in FIG. 1.
Figure 20B:
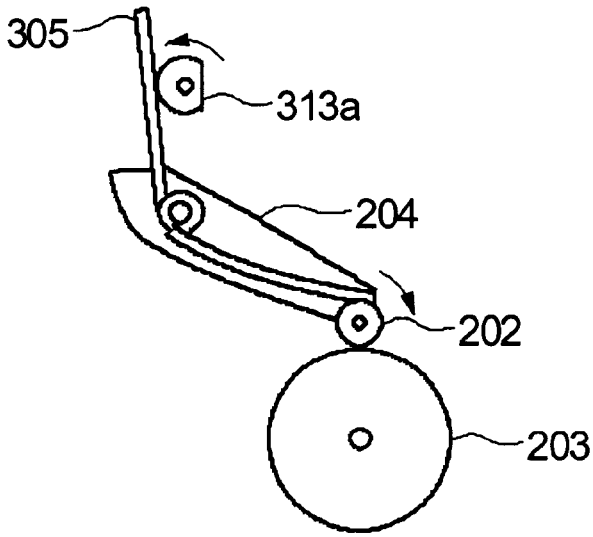
Figure 21:
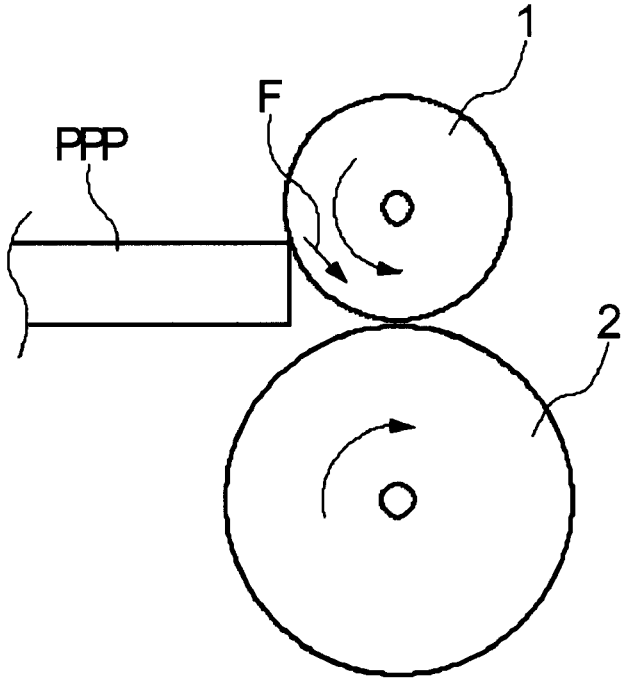
FIG. 21 is a diagram for explaining problems of conventional ink jet printers.

Moreover, in the above embodiments, the following roller 202 is actually released from the paper-feeding roller 203. However, it is not necessary to actually release the following roller 202. Any structure can be adopted as long as the pressing force applied to the printing paper is released. For example, as shown in FIG. 20A, when the D-shaft 313*a* is arranged at the opposite side of the coil spring 315 at which the D-shaft 213*a* shown in FIG. 3 is arranged, the pressing force to the following roller 202 can be released. In this case, the following roller 202 is brought into contact with the paper-feeding roller 203 by the weight thereof. Then, when the D-shaft 313*a* rotates to press the coil spring 305, the pressing force can be applied to the following roller 202.

The member of the pressing-force adjustment portion 200B for pressing the following roller 202 is not limited to the coil spring 205 or 305. Any member formed of elastic material such as rubber can be used. Moreover, when the D-shaft 213*a* is formed in fan shape, an angle range for the operation of the operation lever 201 can be made wider. In addition, although the intermittent gears 214 and 215 are used in order to reduce the moving distance of the print head 100, typical gear gears can be used in place of intermittent gears in a case where there is no limit to the moving distance of the print head 100. In this case, the cost for the parts and components can be reduced.

For example, in the above embodiments, the limit switch 242 is arranged to turn on by positioning the operation lever 201 at the position for the thick paper or the extra-thick paper, so as to issue the ON-signal, thereby prohibiting the bidirectional printing. Alternatively, the control of prohibiting the bidirectional printing may be performed in response to a signal issued from a sensor or the like which electrically or optically detects that the thick paper or the extra-thick paper is manually inserted into the paper feeding-in opening 103.

Although the printer is described as the ink jet recording apparatus in the above embodiments, the ink jet recording apparatus is not limited thereto. The present invention can be applied to other ink jet recording apparatus, such as a facsimile apparatus or a copy apparatus, as long as it includes a feeding mechanism for the recording medium.

As described above, according to the ink jet recording apparatus of the present invention, the paper gap switching portion and the pressing-force adjustment portion can be operated only by the operation of the operation member. Thus, the switching of the paper gaps and the adjustment of the pressing force can be smoothly performed without fail, improving the operability of the user. In addition, since the structures of the operation member, the paper gap switching portion and the pressing force adjustment portion become simple, the design of those mechanisms becomes easier and therefore the design error can be reduced. Also, the cost for the fabrication and assembly and the number of processes in the fabrication and assembly can be reduced.

Moreover, according to the ink jet recording apparatus of the present invention, even in a case where relatively thick paper is used and therefore the paper gap becomes large, the shifts of the dot-positions between two directions in the bidirectional printing cannot occur, thus preventing the printing quality from being degraded. Thus, even if the thickness of the paper is largely varied depending on the type of the thick paper, the stable printing quality can be achieved.

Furthermore, the bidirectional printing can be automatically prohibited only by operating the single operation lever 201 to position at the position for the thick paper or the position for the extra-thick paper. Thus, it is not necessary for the user to select the printing mode on the printer driver or the operation panel for each printing operation for the recording medium having a thickness different from other recoding media. Therefore, it is convenient to the user. In addition, since the adjustment of the paper gap and the determination of the printing mode are performed at the same time, it is very convenient to the user.

Although the present invention has been described by way of exemplary embodiments, it should be understood that those skilled in the art might make many changes and substitutions without departing from the spirit and the scope of the present invention which is defined only by the appended claims.

What is claimed is:

1. An ink jet recording apparatus having a feed roller and a following roller operable to feed said recording medium, and a recording head operable to eject ink droplets onto said recording medium, said apparatus comprising:

a paper gap switching portion operable to switch paper gaps by moving said recording head, wherein said recording head remains substantially parallel to said recording medium as said paper gap is changed;

a pressing-force adjustment portion operable to apply a pressure to said following roller or release said pressure to adjust a pressing force applied to said recording medium; and an operation member operable to operate two series of driving operations including a driving operation of said paper gap switching portion and a driving operation of said pressing-force adjustment portion.

2. An ink jet recording apparatus as claimed in claim 1, wherein said operation member comprises an intermittent gear operable to switch and transmit said two series of driving operations.

3. An ink jet recording apparatus as claimed in claim 1, wherein said operation member, said pressing-force adjustment portion and said paper gap switching portion are formed by a gear mechanism and a link mechanism.

4. An ink jet recording apparatus as claimed in claim 1, wherein said operation member comprises a first intermittent gear having an operation lever, a second intermittent gear arranged to be engagable with said first intermittent gear, and a third intermittent gear arranged to have the same rotation axis as said second intermittent gear;

said pressing-force adjustment portion comprises a fourth intermittent gear arranged to engagable with said second intermittent gear and to have a shaft in which a part of a circumference is formed to be a flat surface, a fifth intermittent gear arranged to be engagable with said third intermittent gear, a following roller arm having one end onto which said following roller is rotatably mounted and another end rotatably attached to said shaft of said fourth intermittent gear, and a coil spring having an end fixed to said following roller, another end that is in contact with said shaft of said fourth intermittent gear and a center part fitted to approximately at a center of said following roller arm;

said paper gap switching portion comprises a first link fitted to a shaft of said fifth intermittent gear at its one end, a second link hinged at its one end to another end of said first link, a third link hinged at its one end to another end of said second link, a fourth link hinged at its one end to said one end of said third link, a fifth link hinged at its one end to another end of said fourth link, and an eccentric cam, to which said recording head is attached, connected to another end of said third link, said fifth link being supported at its another end by a body of said ink jet recording apparatus.

5. An ink jet recording apparatus as claimed in claim 4, further comprising a click mechanism, formed integrally with said operation lever, operable to position said operation lever when said pressing force adjustment portion applies said pressure and when said pressing force adjustment portion releases said pressure.

6. An ink jet recording apparatus as claimed in claim 4, wherein a position of said operation lever when said pressing-force adjustment portion applies said pressure is arranged to be away from a position of said operation lever when said pressing-force adjustment portion releases said pressure.

7. An ink jet recording apparatus as claimed in claim 4, wherein said second link and said forth link are arranged on the same side of said body of said recording apparatus.

8. An ink jet recording apparatus as claimed in claim 1, wherein a maximum one of said paper gaps is provided when said pressing-force adjustment portion release said pressure.

9. An ink jet recording apparatus as claimed in claim 1, wherein said paper gap switching portion switches to a maximum one of said paper gaps when said pressing-force adjustment portion releases said pressure.

10. An ink jet recording apparatus having a feeding roller and a following roller operable to feed a recording medium while interposing said recording medium, and a recording head operable to eject ink droplets on said recording medium, said apparatus comprising:

a paper gap switching portion operable to switch a first paper gap and a second paper gap by moving said print head, said second paper gap being larger than said first paper gap, wherein said recording head remains substantially parallel to said recording medium as said paper gap is changed; and a pressing-force adjustment portion operable to apply a pressure to said following roller or release said pressure to adjust a pressing force applied to said recording medium, wherein three states are switched by a single operation lever, said three states including a state where said first paper gap is set and said pressure is applied, another state where said second paper gap is set and said pressure is applied, and still another state where said pressure is released.

11. An ink jet recording apparatus as claimed in claim 10, wherein switching positions of said operation lever for switching said three states are arranged in series.

12. An ink jet recording apparatus as claimed in claim 11, wherein operations at said switching positions are arrange in an order of setting said first paper gap and applying said pressure, setting said second paper gap and applying said pressure, and releasing said pressure.

13. An ink jet recording apparatus as claimed in claim 10, wherein said paper gap switching portion and said pressing-force adjustment portion are constituted by a gear mechanism and a link mechanism.

14. An ink jet recording apparatus as claimed in claim 10, further comprising an elastic member for applying said pressure applied by said pressing-force adjustment portion.

15. An ink jet recording apparatus, having a print head for ejecting ink droplets on a recording medium, for performing printing for said recording medium by making said print head eject said ink droplets on said recording medium while said print head moves in a main scanning direction and said recording medium is moved in a sub-scanning direction, said apparatus comprising:

a unidirectional printing portion operable to perform unidirectional printing in which said printing is performed in one of two directions contained in said main scanning direction;

a bidirectional printing portion operable to perform bidirectional printing in which said printing is performed in both said two directions contained in said main scanning direction; and a printing-mode controlling portion operable to prohibit said bidirectional printing by said bidirectional printing portion when a thickness of said recording medium is out of a predetermined range, to force said unidirectional printing portion to perform said unidirectional printing.

16. An ink jet recording apparatus, having a print head operable to eject ink droplets on a recording medium, for performing printing by making said print head eject said ink droplets on said recording medium while said print head moves in a main scanning direction and said recording medium is moved in a sub-scanning direction, said apparatus comprising;

a main controlling unit including a unidirectional printing portion operable to perform unidirectional printing in which said printing is performed in one of two directions contained in said main scanning direction and a bidirectional printing portion operable to perform bidirectional printing in which said printing is performed in both said two directions of said main scanning direction; and a paper gap switching portion operable to switch a first paper gap and a second paper gap by moving said print head in accordance with a thickness of said recording medium, said second paper gap being larger than said first paper gap, wherein said main controlling unit further comprises a printing-mode controlling portion operable to prohibit said bidirectional printing by said bidirectional printing portion and to force said unidirectional printing portion to perform said unidirectional printing, when said second paper gap is set by said paper gap switching portion.

17. An ink jet recording apparatus as claimed in claim 16, wherein at least switching between said first paper gap and said second paper gap is performed by a single operation lever, and said printing-mode controlling portion prohibits said bidirectional printing and forces said unidirectional printing portion to perform said unidirectional printing, when said second paper gap is set by said operation lever.

18. An ink jet recording apparatus as claimed in claim 16, wherein the main controlling unit is arranged to allow selection of one of said unidirectional printing and said bidirectional printing, and even in a case where said bidirectional printing is selected, said printing-mode controlling portion expands printing data generated for said bidirectional printing to obtain printing data for said unidirectional printing and only allows said unidirectional printing by said unidirectional printing portion, when said thickness of said recording medium is out of a predetermined range or said second paper gap is set.

19. An ink jet recording apparatus as claimed in claim 16, wherein said paper gap switching portion is constituted by a gear mechanism and a link mechanism.

20. An ink jet recording apparatus having a feed roller and a following roller operable to feed said recording medium, and a recording head operable to eject ink droplets onto said recording medium, said apparatus comprising:

a paper gap switching portion that switches paper gaps by moving said recording head, wherein said recording head remains substantially parallel to said recording medium as said paper gap is changed;

pressing-force adjustment portion that applies a pressure to said following roller and releases said pressure to adjust a pressing force applied to said recording medium; and an operation member that controls a driving operation of said paper gap switching portion and a driving operation of said pressing-force adjustment portion.

21. An ink jet recording apparatus having a feeding roller and a following roller operable to feed a recording medium, and a recording head operable to eject ink droplets on said recording medium, said apparatus comprising:

a paper gap switching portion that switches between a first paper gap and a second paper gap by moving said print head, said second paper gap being larger than said first paper gap, wherein said recording head remains substantially parallel to said recording medium as said paper gap is changed; and a pressing-force adjustment portion that applies a pressure to said following roller and releases said pressure to adjust a pressing force applied to said recording medium, wherein three states are switched by a single operation lever, said three states including a state where said first paper gap is set and said pressure is applied, another state where said second paper gap is set and said pressure is applied, and still another state where said pressure is released.

22. An ink jet recording apparatus having a feed roller and a following roller operable to feed said recording medium, and a recording head operable to eject ink droplets onto said recording medium, said apparatus comprising:

a paper gap switching portion operable to switch paper gaps by moving said recording head;

a pressing-force adjustment portion operable to apply a pressure to said following roller or release said pressure to adjust a pressing force applied to said recording medium; and an operation member operable to operate two series of driving operations including a driving operation of said paper gap switching portion and a driving operation of said pressing-force adjustment portion, wherein said operation member comprises an intermittent gear operable to switch and transmit said two series of driving operations.

* * * * *